US007778113B2

(12) United States Patent
Machida et al.

(10) Patent No.: US 7,778,113 B2
(45) Date of Patent: Aug. 17, 2010

(54) ULTRASONIC TRANSDUCER AND MANUFACTURING METHOD THEREOF

(75) Inventors: Shuntaro Machida, Kokubunji (JP); Hiroyuki Enomoto, Musashino (JP)

(73) Assignee: Hitachi, Ltd., Tokyo (JP)

( * ) Notice: Subject to any disclaimer, the term of this patent is extended or adjusted under 35 U.S.C. 154(b) by 59 days.

(21) Appl. No.: 11/867,681

(22) Filed: Oct. 4, 2007

(65) Prior Publication Data

US 2008/0259733 A1 Oct. 23, 2008

(30) Foreign Application Priority Data

Oct. 5, 2006 (JP) ..... 2006-274284

(51) Int. Cl.
*H04R 17/00* (2006.01)

(52) U.S. Cl. ..... 367/181

(58) Field of Classification Search ..... 367/87–190
See application file for complete search history.

(56) References Cited

U.S. PATENT DOCUMENTS 5,894,452 A 4/1999 Ladabaum et al.
5,982,709 A 11/1999 Ladabaum et al.
6,632,178 B1 * 10/2003 Fraser ..... 600/459
7,489,593 B2 * 2/2009 Nguyen-Dinh et al. ..... 367/181
2004/0085858 A1 5/2004 Khuri-Yakub et al.

* cited by examiner

*Primary Examiner*—Thomas H Tarcza
*Assistant Examiner*—Luke D Ratcliffe
(74) *Attorney, Agent, or Firm*—Miles & Stockbridge P.C.

(57) ABSTRACT

A technology capable of improving receiver sensitivity and improving insulation withstand voltage in an ultrasonic transducer is provided. An ultrasonic transducer comprises: a lower electrode; an insulator covering the lower electrode; a cavity portion disposed on the insulator so as to overlap with the lower electrode; and an upper electrode disposed so as to overlap with the cavity portion. In this ultrasonic transducer, an insulator is inserted between the upper and lower electrodes in a part not having the cavity portion. By this means, sum total of thickness of insulators between the upper and lower electrodes in a part not having the cavity portion is larger than sum total of thickness of insulators between the upper and lower electrodes in a part having the cavity portion.

13 Claims, 28 Drawing Sheets

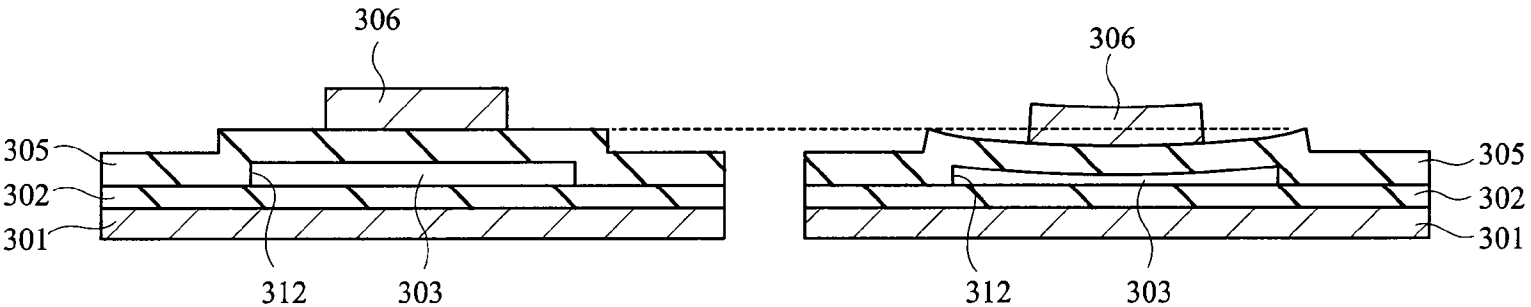
FIG. 17A
FIG. 17B
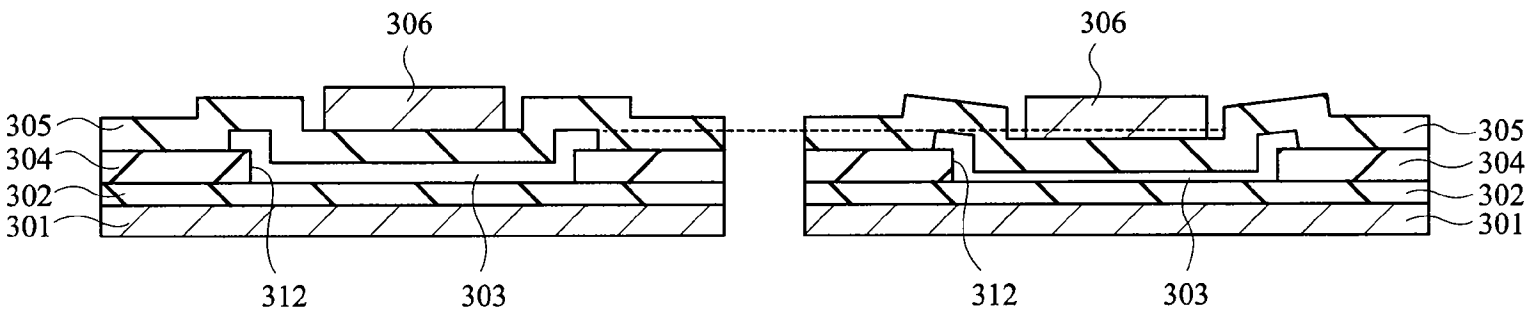
FIG. 17C
FIG. 17D

ULTRASONIC TRANSDUCER AND MANUFACTURING METHOD THEREOF

CROSS-REFERENCE TO RELATED APPLICATION

The present application claims priority from Japanese Patent Application No. JP 2006-274284 filed on Oct. 5, 2006, the content of which is hereby incorporated by reference into this application.

TECHNICAL FIELD OF THE INVENTION

The present invention relates to an ultrasonic transducer and its manufacturing technology. More particularly, the present invention relates to an ultrasonic transducer manufactured by MEMS (Micro Electro Mechanical System) technology and its optimum manufacturing technology.

BACKGROUND OF THE INVENTION

The ultrasonic transducer is used in a device for diagnosing a tumor in a human body by transmitting and receiving ultrasonic waves.

The ultrasonic transducer utilizing the vibration of a piezoelectric body has been used so far. However, with the recent progress in the MEMS technology, a capacitive micromachined ultrasonic transducer (CMUT) in which a vibrating portion having a structure in which a cavity portion (gap) is sandwiched between electrodes is fabricated on a silicon substrate has been actively developed for achieving its practical use.

For example, U.S. Pat. No. 5,894,452 (Patent Document 1) discloses the CMUT cell in which a cavity portion is formed by etching an insulator sandwiched between electrodes. In this CMUT cell, holes are opened in a membrane, and the shape of the cavity portion is controlled by means of the arrangement of the holes.

Also, US Patent Application Publication No. US 2004/0085858 A1 (Patent Document 2) discloses the CMUT cell having a structure in which a cavity is formed by bonding a silicon substrate onto an insulator having a concave portion formed therein.

Further, U.S. Pat. No. 5,982,709 (Patent Document 3) discloses the technology for forming the CMUT cell having a structure in which the size of a cavity portion is defined in advance as a sacrificial layer.

SUMMARY OF THE INVENTION

In comparison with the conventional ultrasonic transducer using a piezoelectric body, the CMUT has advantages that the usable frequency band of ultrasonic wave is wide and high sensitivity can be achieved.

Further, the CMUT can be microfabricated because it is formed using the LSI process technology. In particular, in the case where one type of ultrasonic elements (CMUT cell) are arranged in an array and each of the elements is independently controlled, the CMUT is considered indispensable as an ultrasonic element. This is because, although it is expected that wirings to each element become necessary and the number of wirings in an array becomes enormous, the CMUT enables such wirings as well as the embedment of a signal processing circuit into one chip from ultrasonic transmitting and receiving units.

Therefore, the inventors of the present invention have made examinations about the CMUT among various ultrasonic transducers. FIG. 36 and FIG. 37 schematically show the cross sections of the CMUT cells examined by the inventors of the present invention. The basic structure and the operation of the CMUT cell examined by the inventors will be described below.

In FIG. 36 and FIG. 37, a reference numeral 101 denotes a lower electrode, 102 denotes an insulator, 103 denotes a cavity portion, 104 denotes an insulator, and 105 denotes an upper electrode. The CMUT cell has the structure in which the cavity portion 103 is sandwiched between the upper electrode 105 and the lower electrode 101. The insulator 104 and the upper electrode 105 form a membrane 106, and this membrane 106 vibrates when transmitting and receiving ultrasonic waves.

First, the operation of transmitting ultrasonic waves will be described. When DC voltage and AC voltage are superimposed to the upper electrode 105 and the lower electrode 101, electrostatic force acts between the upper electrode 105 and the lower electrode 101, and the upper electrode 105 and the insulator 104 on the cavity portion 103 constituting the membrane 106 vibrate at the frequency of the applied AC voltage, and thus transmitting the ultrasonic waves.

Next, the operation of receiving ultrasonic waves will be described. The membrane 106 on the cavity portion 103 is vibrated by the pressure of the ultrasonic waves that reach the surface of the CMUT cell. Since the distance between the upper electrode 105 and the lower electrode 101 changes due to this vibration, the ultrasonic waves can be detected as the change in the electric capacitance between the electrodes. More specifically, when the distance between electrodes changes, the electric capacitance between the electrodes also changes and the current flows. By detecting this current, the ultrasonic waves can be detected.

As is apparent from the operation principle described above, since the ultrasonic waves are transmitted and received by using the vibration of the membrane due to the electrostatic force caused by applying the voltage between electrodes and the change in electric capacitance between the electrodes due to the vibration, the improvement in withstand voltage between electrodes and the suppression of the parasitic capacitance between electrodes in a part not having the cavity portion are important points for improving the reliability of the device, increasing the transmission strength of ultrasonic waves, and improving the receiver sensitivity.

Patent Document 1 discloses a CMUT cell in which a cavity portion is formed by etching an insulator sandwiched between electrodes. In this case, holes are opened in a membrane, and a shape of the cavity portion is controlled by the arrangement of the holes. Further, Patent Document 2 discloses a CMUT cell in which a trench is formed in an insulator formed on a lower electrode and a silicon substrate as a lid is bonded onto the trench, thereby forming a membrane.

In the CMUT cell shown in FIG. 36 having the structure similar to those disclosed in Patent Documents 1 and 2, the space between the upper electrode 105 and the lower electrode 101 is the same in a part having the cavity portion 103 and the other part (part between the upper electrode 105 and the lower electrode 101 and including the insulator 102), and the independent control thereof is impossible. Therefore, for example, when the thickness of the insulator 102 is increased in order to suppress the electric parasitic capacitance in the part not having the cavity portion 103 or improve the withstand voltage between electrodes, the distance between the electrodes sandwiching the cavity portion 103 is also increased, and the amount of change in electric capacitance at the time of receiving ultrasonic waves is decreased. In other words, when the distance between the electrodes sandwiching the cavity portion 103 is increased, the receiver sensitivity is lowered.

Patent Document 3 discloses a CMUT cell in which a sacrificial layer to be a mold of a cavity portion is formed on a lower electrode, an insulator and an upper electrode are formed so as to cover the sacrificial layer, and then the sacrificial layer is removed, thereby forming the cavity portion.

In the CMUT cell shown in FIG. 37 having the structure similar to that disclosed in Patent Document 3, the space between the upper electrode 105 and the lower electrode 101 corresponds to the sum of the thickness of the cavity portion 103 and the thickness of the insulator 102 in a part having the cavity portion 103 and corresponds to only the thickness of the insulator 102 in a part not having the cavity portion 103 (part between the upper electrode 105 and the lower electrode 101 and including the insulator 102), and the independent control thereof is impossible. Accordingly, similar to the CMUT cell having the structure disclosed in Patent Documents 1 and 2, when the thickness of the insulator 102 is increased in order to suppress the electric parasitic capacitance in the part not having the cavity portion 103 or improve the withstand voltage between electrodes, the distance between the electrodes sandwiching the cavity portion 103 is also increased, and the amount of change in electric capacitance at the time of receiving ultrasonic waves is decreased. Further, since the upper electrode 105 is structured to extend over the step portion of the cavity portion 103, the electric field concentration occurs at the corner portion of the electrode formed by the step portion, and the withstand voltage is further lowered.

An object of the present invention is to provide a technology capable of suppressing the decrease in receiver sensitivity and improving the withstand voltage of an ultrasonic transducer, especially, a CMUT.

The above and other objects and novel characteristics of the present invention will be apparent from the description of this specification and the accompanying drawings.

The typical ones of the inventions disclosed in this application will be briefly described as follows.

An ultrasonic transducer according to the present invention comprises: a first electrode; a first insulator which covers the first electrode; a cavity portion disposed so as to overlap with the first electrode; and a second electrode disposed so as to overlap with the cavity portion, wherein a second insulator is inserted between the first electrode and the second electrode in a part not having the cavity portion. Also, sum total of thickness of insulators between the first electrode and the second electrode in the part not having the cavity portion is larger than sum total of thickness of insulators between the first electrode and the second electrode in a part having the cavity portion.

Further, an ultrasonic transducer according to the present invention comprises: a first electrode; a first insulator which covers the first electrode; a cavity portion disposed so as to overlap with the first electrode; and a second electrode disposed so as to overlap with the cavity portion, wherein a distance between the first electrode and the second electrode in a part not having the cavity portion is larger than a distance between the first electrode and the second electrode in a part having the cavity portion.

Further, an ultrasonic transducer according to the present invention comprises: a first electrode; a second electrode opposite to the first electrode; a cavity portion between the first electrode and the second electrode; and an insulator between the first electrode and the second electrode in a part not having the cavity portion. Here, a distance between the first electrode and the second electrode in a part not having the cavity portion is larger than a distance between the first electrode and the second electrode in a part where a central part of the cavity portion is located.

Further, a manufacturing method of an ultrasonic transducer according to the present invention comprises the steps of: (a) forming a first electrode; (b) forming a first insulator which covers the first electrode; (c) forming a sacrificial layer on the first insulator so as to overlap with the first electrode; (d) forming a second insulator which covers the sacrificial layer and the first insulator; (e) forming an opening portion, which reaches the sacrificial layer and is smaller than the sacrificial layer in size when viewed from top, in the second insulator on the sacrificial layer; (f) forming a third insulator which covers the opening portion and the second insulator; (g) forming a second electrode, which overlaps with the sacrificial layer, on the third insulator; (h) forming a fourth insulator which covers the second electrode and the third insulator; (i) forming an opening portion which reaches the sacrificial layer through the third insulator and the fourth insulator; (j) forming a cavity portion by removing the sacrificial layer through the opening portion; and (k) burying the opening portion with a fifth insulator, thereby sealing the cavity portion.

Further, a manufacturing method of an ultrasonic transducer according to the present invention comprises the steps of: (a) forming a first electrode; (b) forming a first insulator which covers the first electrode; (c) forming a second insulator which covers the first insulator; (d) forming an opening portion, which reaches the first insulator, in the second insulator; (e) forming a sacrificial layer, which overlaps with the first electrode and is larger than the opening portion in size when viewed from top, on the second insulator and the opening portion; (f) forming a third insulator which covers the sacrificial layer and the second insulator; (g) forming a second electrode, which overlaps with the sacrificial layer, on the third insulator; (h) forming a fourth insulator which covers the second electrode and the third insulator; (i) forming an opening portion which reaches the sacrificial layer through the fourth insulator and the third insulator; (j) forming a cavity portion by removing the sacrificial layer through the opening portion; and (k) burying the opening portion with a fifth insulator, thereby sealing the cavity portion.

Further, a manufacturing method of an ultrasonic transducer according to the present invention comprises the steps of: (a) forming a first electrode; (b) forming a first insulator which covers the first electrode; (c) forming a trench, which does not reach the first electrode, in the first insulator; (d) forming a second electrode which covers the first insulator and the trench of the first insulator; (e) forming an opening portion, which reaches the first insulator, in the second electrode in the trench of the first insulator; (f) forming a cavity portion by removing the first insulator through the opening portion; and (g) burying the opening portion with a second insulator, thereby sealing the cavity portion.

The effects obtained by typical aspects of the present invention will be briefly described below.

According to the present invention, it is possible to provide the structure in which the decrease in receiver sensitivity of a CMUT can be suppressed and the withstand voltage thereof can be improved by independently controlling the distance between electrodes in a part having the cavity portion and in a part not having the cavity portion, and the manufacturing method thereof.

BRIEF DESCRIPTIONS OF THE DRAWINGS

FIG. 17A is a diagram for describing an operation of the CMUT cell according to the second embodiment of the present invention, which shows the non-operation state of the CMUT cell having no ridge portion;

FIG. 17B is a diagram for describing an operation of the CMUT cell according to the second embodiment of the present invention, which shows the operation state of the CMUT cell having no ridge portion;

FIG. 17C is a diagram for describing an operation of the CMUT cell according to the second embodiment of the present invention, which shows the non-operation state of the CMUT cell having ridge portions;

FIG. 17D is a diagram for describing an operation of the CMUT cell according to the second embodiment of the present invention, which shows the operation state of the CMUT cell having ridge portions;

DESCRIPTIONS OF THE PREFERRED EMBODIMENTS

In the embodiments described below, the invention will be described in a plurality of sections or embodiments when required as a matter of convenience. However, these sections or embodiments are not irrelevant to each other unless otherwise stated, and the one relates to the entire or a part of the other as a modification example, details, or a supplementary explanation thereof.

Also, in the embodiments described below, when referring to the number of elements (including number of pieces, values, amount, range, and the like), the number of the elements is not limited to a specific number unless otherwise stated or except the case where the number is apparently limited to a specific number in principle. The number larger or smaller than the specified number is also applicable.

Further, in the embodiments described below, it goes without saying that the components (including element steps) are not always indispensable unless otherwise stated or except the case where the components are apparently indispensable in principle.

Similarly, in the embodiments described below, when the shape of the components, positional relation thereof, and the like are mentioned, the substantially approximate and similar shapes and the like are included therein unless otherwise stated or except the case where it can be conceived that they are apparently excluded in principle. The same goes for the numerical value and the range described above.

Further, hatching is used in some cases even in a plan view so as to make the drawings easy to see.

In the description of the embodiments below, the object of suppressing the decrease in receiver sensitivity of an ultrasonic transducer and improving the withstand voltage thereof is achieved by forming the structure in which the distance between electrodes in a part having a cavity portion and that in a part not having the cavity portion can be independently controlled.

First Embodiment

Figure 1:
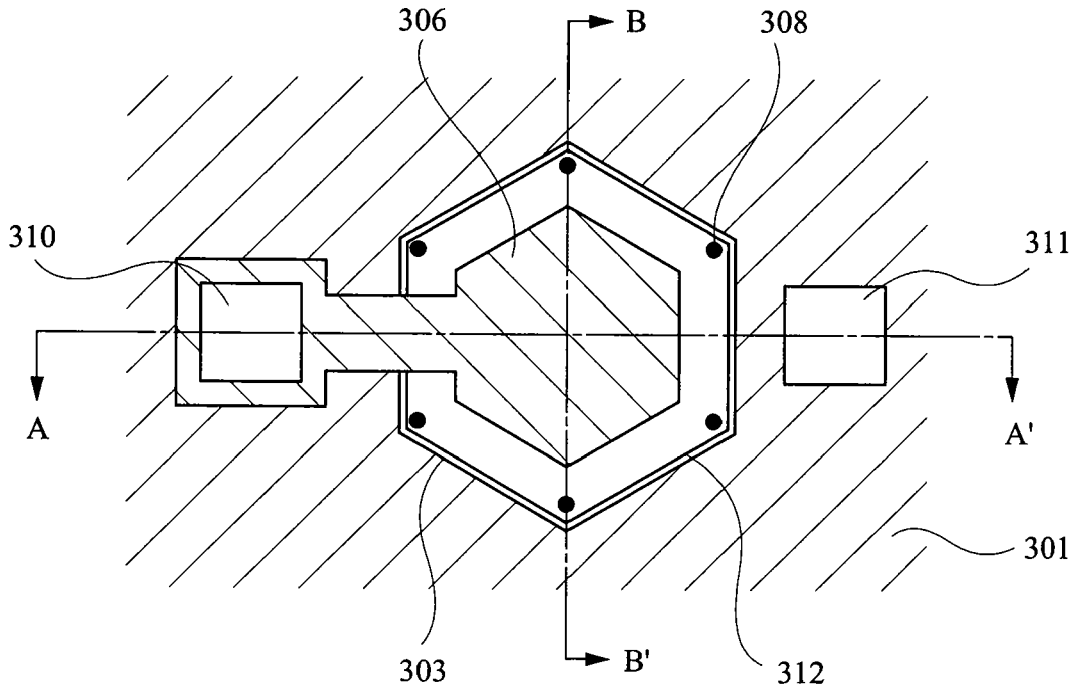
FIG. 1 is a plan view schematically showing the CMUT cell according to the first embodiment of the present invention.
Figure 2A:
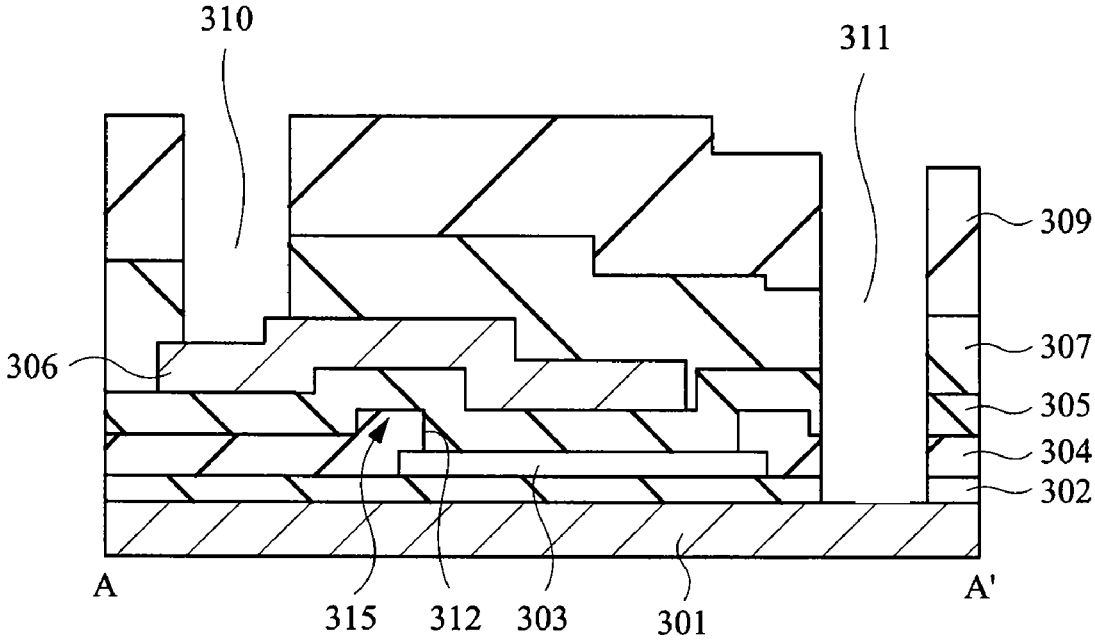
FIG. 2A is a cross-sectional view schematically showing the cross section of the CMUT cell taken along the line A-A' in FIG. 1 according to the first embodiment of the present invention.
Figure 2B:
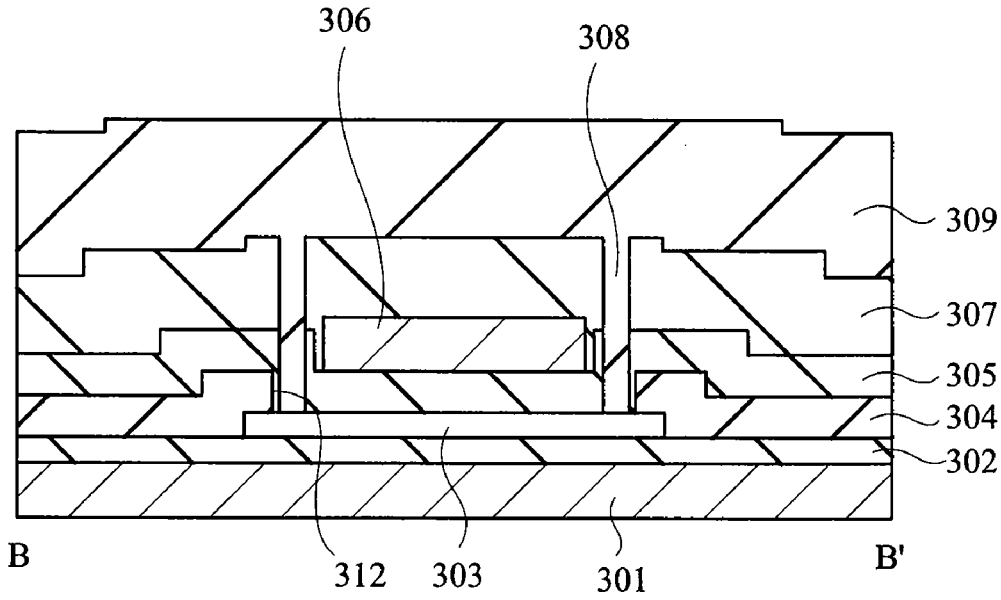
FIG. 2B is a cross-sectional view schematically showing the cross section of the CMUT cell taken along the line B-B' in FIG. 1 according to the first embodiment of the present invention.

First, a structure of a CMUT cell according to the first embodiment of the present invention will be described with reference to FIG. 1 and FIG. 2. FIG. 1 is a plan view schematically showing an upper surface of the CMUT cell, and FIG. 2A and FIG. 2B are cross-sectional views schematically showing the CMUT cell, in which FIG. 2A shows a cross section taken along the line A-A' in FIG. 1 and FIG. 2B shows a cross section taken along the line B-B' in FIG. 1.

In FIG. 1 and FIG. 2, a reference numeral 301 denotes a lower electrode, 302, 304, 305, 307 and 309 denote insulators, 303 denotes a cavity portion, 306 denotes an upper electrode, and 308 denotes a wet etching hole for forming the cavity portion 303. More specifically, the wet etching hole 308 is connected to the cavity portion 303. Further, a reference numeral 310 denotes a pad opening portion for supplying power to the upper electrode 306, and a reference numeral 311 denotes a pad opening portion for supplying power to the lower electrode 301. Note that, in FIG. 1, the insulators 305, 307 and 309 are not illustrated in order to show the cavity portion 303 and the upper electrode 306. For the same reason, the insulator 304 is not illustrated, but a side surface 312 of the opening portion is illustrated in order to show the positional relation of the opening of the insulator 304. Further, a membrane of the CMUT cell in the first embodiment is constituted of the insulators 305, 307 and 309 and the upper electrode 306.

Incidentally, although the upper electrode 306 is defined to include a pad and wirings for supplying power from the pad opening portion 310 in the present invention, it is the upper electrode 306 on the central part of the cavity portion 303 that is actually applied to the transmission and reception of the ultrasonic waves.

In the CMUT cell according to the first embodiment, as shown in FIG. 2, the insulator 302, the insulator 304, the insulator 305, the insulator 307 and the insulator 309 are disposed in this order on the lower electrode 301. In these insulators 302, 304, 305, 307 and 309, a part (pad) of the lower electrode 301 is exposed through the opening portion 311 formed from the insulator 309 to the part (pad) of the lower electrode 301. Also, the upper electrode 306 is disposed so as to be sandwiched between the insulator 305 and the insulator 307. Further, in the insulators 309 and 307, a part (pad) of the upper electrode 306 is exposed through the opening portion 310 formed from the insulator 309 to the part (pad) of the upper electrode 306. Furthermore, an opening portion is formed in the insulator 304, and the insulator 305 is disposed so as to bury the opening portion.

Figure 37:
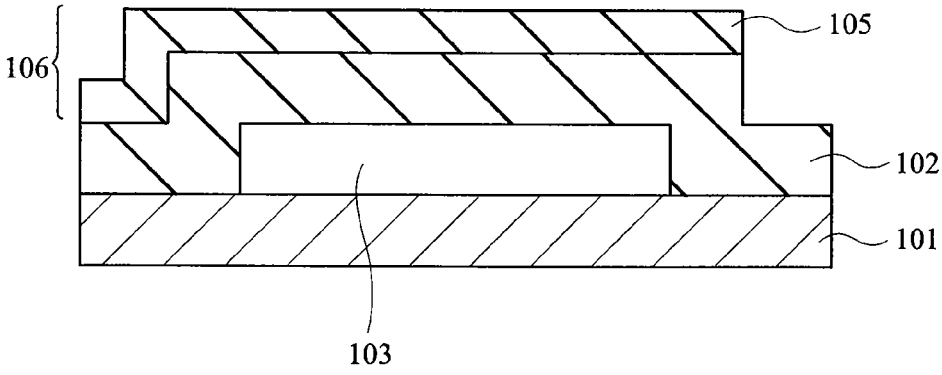
FIG. 37 is a cross-sectional view schematically showing another example of the CMUT cell examined by the inventors of the present invention.

Also, the cavity portion 303 is disposed between the lower electrode 301 and the upper electrode 306. This cavity portion 303 is surrounded by the insulator 302 disposed on a lower side thereof, the insulator 304 disposed on lateral sides and a part of an upper side thereof so as to extend over the step portion of the cavity portion 303, and the insulator 305 disposed on the other part of the upper side thereof. The insulator 305 disposed on the other part of the upper side of the cavity portion 303 is formed so as to bury the opening portion in the insulator 304 on the cavity portion 303. Note that, in the case where the insulator 304 is not disposed, the CMUT cell having the same structure as that shown in FIG. 37 is obtained. In other words, the CMUT cell according to the first embodiment has the structure obtained by inserting the insulator 304 having an opening portion into the structure of the CMUT shown in FIG. 37.

As described above, the CMUT cell according to the first embodiment has the lower electrode 301, the insulator 302 which covers the lower electrode 301, the cavity portion 303 disposed so as to overlap with the lower electrode 301, and the upper electrode 306 disposed so as to overlap with the cavity portion 303, and the insulator 304 is inserted between the lower electrode 301 and the upper electrode 306 in a part not having the cavity portion 303. Accordingly, the sum total of the thickness of the insulators 302, 304 and 305 between the lower electrode 301 and the upper electrode 306 in a part not having the cavity portion 303 is larger than the sum total of the thickness of the insulators 302 and 305 between the lower electrode 301 and the upper electrode 306 in a part having the cavity portion 303.

Further, as shown in FIG. 1, the cavity portion 303 of the CMUT cell has a hexagonal planar shape. As described above, the insulator 304 is formed on a part of an upper side of the cavity portion 303 so as to extend over the step portion of the cavity portion 303 and the insulator 305 is formed on the other part of the upper side of the cavity portion 303, in other words, it is buried in the opening portion of the insulator 304. Therefore, on the upper side of the cavity portion 303 having a hexagonal planar shape, the insulator 305 is disposed in the central part of the cavity portion 303, and the insulator 304 is disposed in the edge portion (outer periphery) thereof.

Also, as is known from the side surface 312 of the opening portion shown in FIG. 1, the planar shape of the opening portion of the insulator 304 on the cavity portion 303 is smaller than the planar shape of the cavity portion 303. In other words, the insulator 304 having an opening portion whose diameter is smaller than the cavity portion 303 is disposed on the cavity portion 303. Further, the planar shape of the upper electrode 306 above the cavity portion 303 is smaller than the opening portion of the insulator 304. The upper electrode 306 above the cavity portion 303 has a hexagonal planar shape similar to the planar shape of the cavity portion 303. The wiring is extended from the hexagonal portion to the pad, thereby constituting the upper electrode 306. Note that the planar shape of the opening portion of the insulator 304 is designed so as not to be larger than the planar shape of the cavity portion 303.

In the CMUT cell according to the first embodiment, the insulator 304 having an opening portion whose diameter is smaller than the cavity portion 303 is inserted on the cavity portion 303 in the manner as described above, thereby increasing the thickness of the insulators between the electrodes in a part not having the cavity portion 303. In this structure, the space between electrodes in a part where the cavity portion 303 is located and the space between electrodes in a part where the cavity portion 303 is not located can be controlled independently, and it is possible to make a difference between them. Accordingly, the thickness of the insulators sandwiched between the lower electrode 301 and the upper electrode 306 in a part not having the cavity portion 303 can be increased without increasing the space between the lower electrode 301 and the upper electrode 306 in a part having the cavity portion 303. Therefore, in the CMUT cell according to the first embodiment, the decrease in the receiver sensitivity can be suppressed and the withstand voltage can be improved. More specifically, since the space between the upper electrode 306 and the lower electrode 301 in a part having the cavity portion 303 remains unchanged, the amount of change in electric capacitance at the time of receiving ultrasonic waves is not changed, and also, since the thickness of the insulators sandwiched between the upper electrode 306 and the lower electrode 301 in a part not having the cavity portion 303 can be increased, the electric parasitic capacitance can be suppressed.

Further, in the edge portion (outer periphery) of the upper surface of the cavity portion 303, the insulator 304 is disposed to extend over the cavity portion 303, and the insulator 305 is disposed on the insulator 304. Therefore, the thickness of the insulator can be increased in a step portion 315 around the edge portion where the insulator 304 extends over the cavity portion 303. Accordingly, the upper electrode 306 disposed on the insulator 305 also extends over the step portion formed by the cavity portion 303 in this structure. However, since the thickness of the insulator of the step portion 315 is also increased around the edge portion of the cavity portion 303, the insulation resistance to the electric field concentration related to the lower electrode 301 from the corner portion of the upper electrode 306 can be improved.

Note that, in the CMUT cell according to the first embodiment, between the lower electrode 301 and the upper electrode 306 in a part having the cavity portion 303, the insulator 302 is disposed on the side of the lower electrode 301 and the insulator 305 is disposed on the side of the upper electrode 306. These insulators 302 and 305 have a function to prevent the direct contact of the upper electrode 306 with the lower electrode 301 even if the upper electrode 306 vibrates when the CMUT cell transmits and receives ultrasonic waves. Therefore, it is also preferable to provide the insulator only on the side of the lower electrode 301 or the side of the upper electrode 306 as long as the contact with the lower electrode 301 can be prevented when the upper electrode 306 vibrates.

Next, the manufacturing method of the CMUT cell using the MEMS technology according to the first embodiment of the present invention will be described with reference to FIG. 3 to FIG. 12. FIG. 3 to FIG. 12 are cross-sectional views schematically showing the CMUT cell in the manufacturing process, in which FIG. 3A to FIG. 12A show the cross sections taken along the line A-A' in FIG. 1 and FIG. 3B to FIG. 12B show the cross sections taken along the line B-B' in FIG. 1.

Figure 3A:
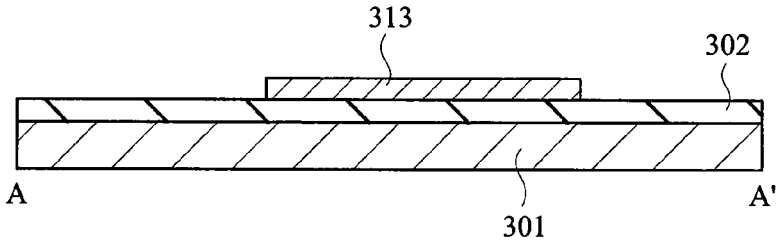
FIG. 3A is a cross-sectional view showing the CMUT cell in the manufacturing process taken along the line A-A' in FIG. 1 according to the first embodiment of the present invention.
Figure 3B:
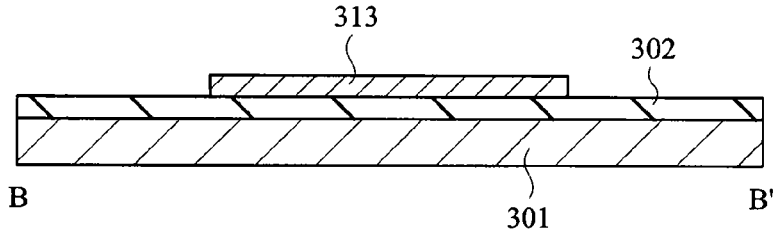
FIG. 3B is a cross-sectional view showing the CMUT cell in the manufacturing process taken along the line B-B' in FIG. 1 according to the first embodiment of the present invention.

First, as shown in FIG. 3A and FIG. 3B, the insulator 302 formed of a silicon oxide film is deposited to 100 nm on the lower electrode 301 formed of a conductive film by the plasma CVD (Chemical Vapor Deposition) method.

Next, a polycrystalline silicon film is deposited to 100 nm on the insulator 302 by the plasma CVD method. Then, the polycrystalline silicon film is patterned through photolithography process and dry etching process to be left on the lower electrode 301. The film left on the lower electrode 301 is the sacrificial layer 313, and it turns to the cavity portion 303 in the subsequent process.

Figure 4A:
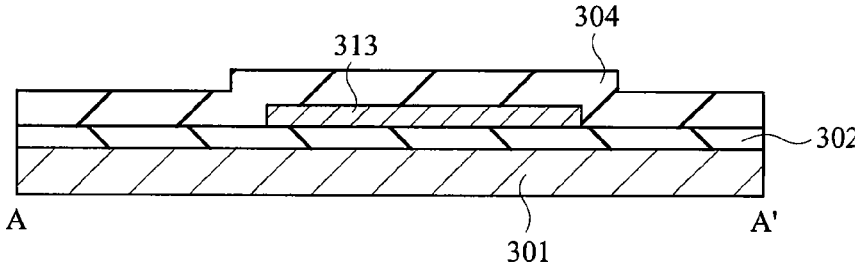
FIG. 4A is a cross-sectional view showing the CMUT cell in the manufacturing process continued from FIG. 3A taken along the line A-A' in FIG. 1.
Figure 4B:
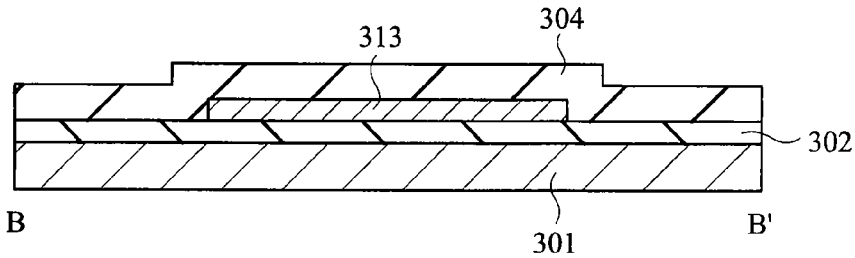
FIG. 4B is a cross-sectional view showing the CMUT cell in the manufacturing process continued from FIG. 3B taken along the line B-B' in FIG. 1.

Then, the insulator 304 formed of a silicon oxide film is deposited to 200 nm by the plasma CVD method so as to cover the sacrificial layer 313 and the insulator 302 (FIG. 4A and FIG. 4B).

Figure 5A:
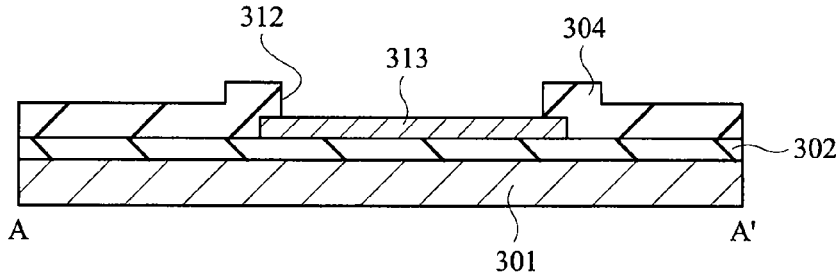
FIG. 5A is a cross-sectional view showing the CMUT cell in the manufacturing process continued from FIG. 4A taken along the line A-A' in FIG. 1.
Figure 5B:
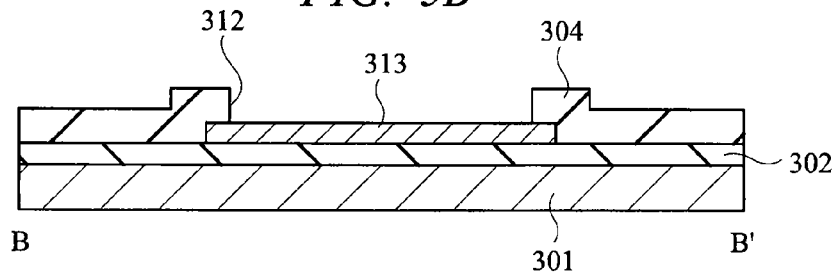
FIG. 5B is a cross-sectional view showing the CMUT cell in the manufacturing process continued from FIG. 4B taken along the line B-B' in FIG. 1.

Next, an opening portion is formed in the insulator 304 through photolithography process and dry etching process so as to overlap with the sacrificial layer 313. The opening portion is formed so that the side surface 312 of the opening portion is located on the sacrificial layer 313 to be the cavity portion 303 (FIG. 5A and FIG. 5B).

In this structure, the sacrificial layer 313 serves as an etching stopper layer in the dry etching for forming the opening portion in the insulator 304. In this case, since the etching selectivity between the insulator 304 formed of a silicon oxide film and the sacrificial layer 313 made of polycrystalline silicon can be sufficiently ensured, the etching of the insulator 304 can be easily stopped by the sacrificial layer 313. A width determined with taking into account the alignment error with the sacrificial layer 313 in the lithography for forming the opening portion of the insulator 304 can be set as the width of the insulator 304 from the side surface 312 of the opening portion that is overlapped on the sacrificial layer 313.

Figure 6A:
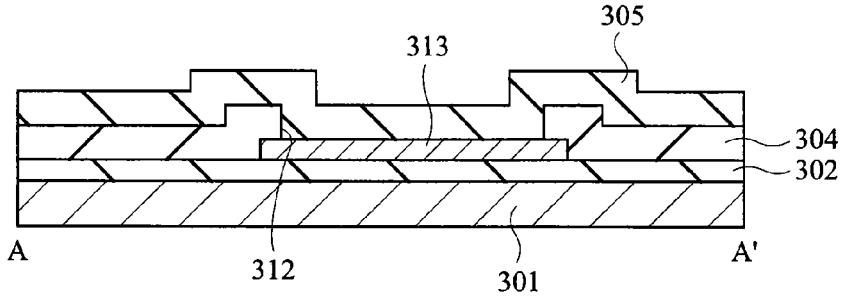
FIG. 6A is a cross-sectional view showing the CMUT cell in the manufacturing process continued from FIG. 5A taken along the line A-A' in FIG. 1.
Figure 6B:
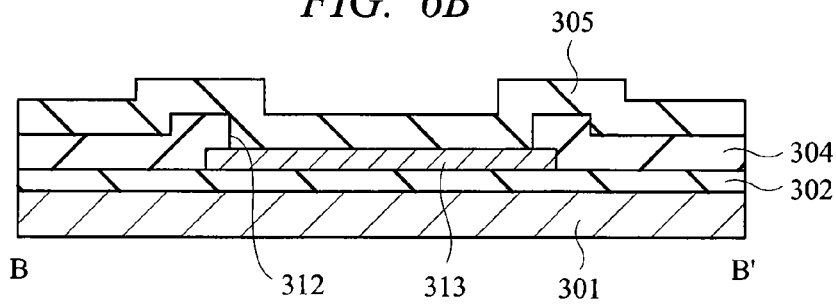
FIG. 6B is a cross-sectional view showing the CMUT cell in the manufacturing process continued from FIG. 5B taken along the line B-B' in FIG. 1.

Next, the insulator 305 formed of a silicon oxide film is deposited to 200 nm by the plasma CVD method so as to cover the insulator 304 and the opening portion thereof (FIG. 6A and FIG. 6B). That is, the opening portion of the insulator 304 is buried with the insulator 305.

Figure 7A:
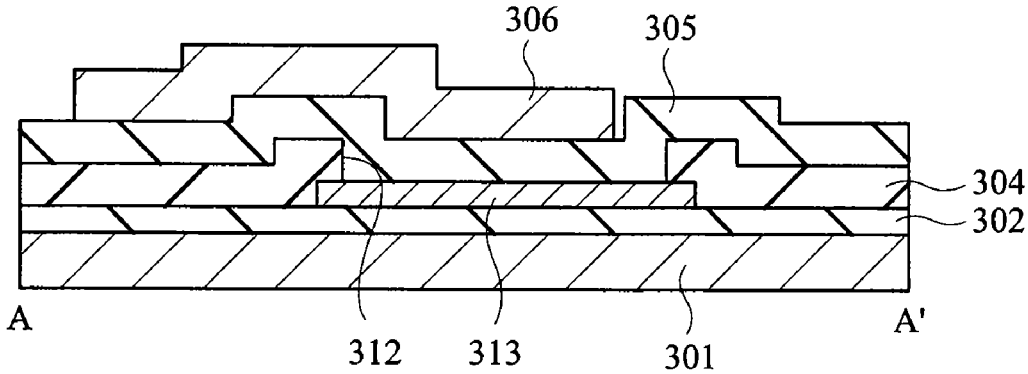
FIG. 7A is a cross-sectional view showing the CMUT cell in the manufacturing process continued from FIG. 6A taken along the line A-A' in FIG. 1.
Figure 7B:
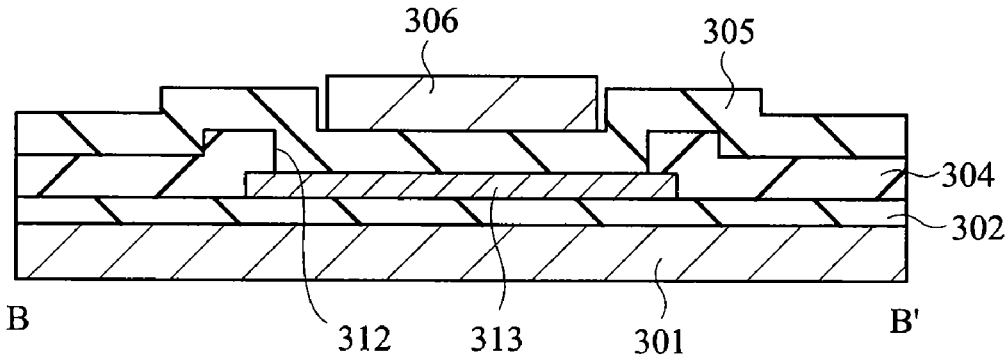
FIG. 7B is a cross-sectional view showing the CMUT cell in the manufacturing process continued from FIG. 6B taken along the line B-B' in FIG. 1.

Subsequently, in order to form the upper electrode 306 of the CMUT cell, a laminated film of a titanium nitride film of 50 nm, an aluminum alloy film of 300 nm and a titanium nitride film of 50 nm is deposited by the sputtering method. Then, the laminated film is patterned through photolithography process and dry etching process to form the upper electrode 306 (FIG. 7A and FIG. 7B).

Figure 8A:
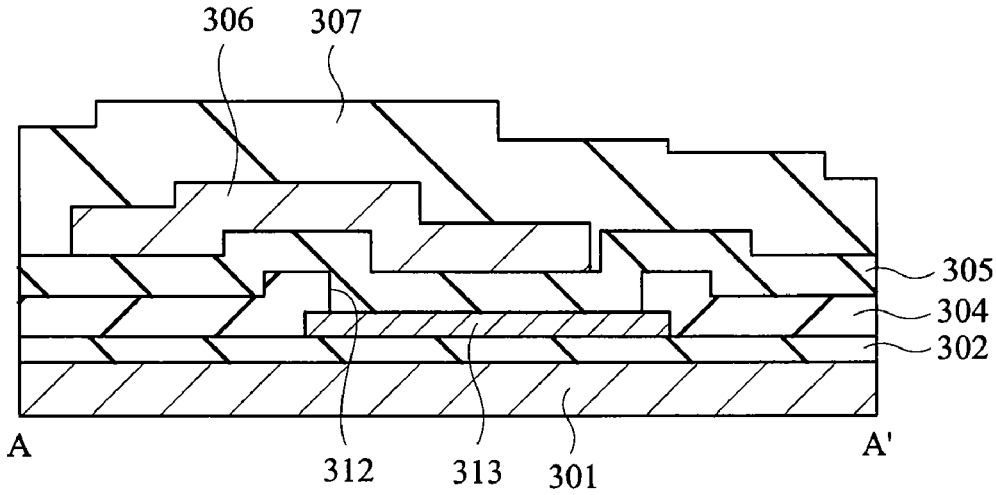
FIG. 8A is a cross-sectional view showing the CMUT cell in the manufacturing process continued from FIG. 7A taken along the line A-A' in FIG. 1.
Figure 8B:
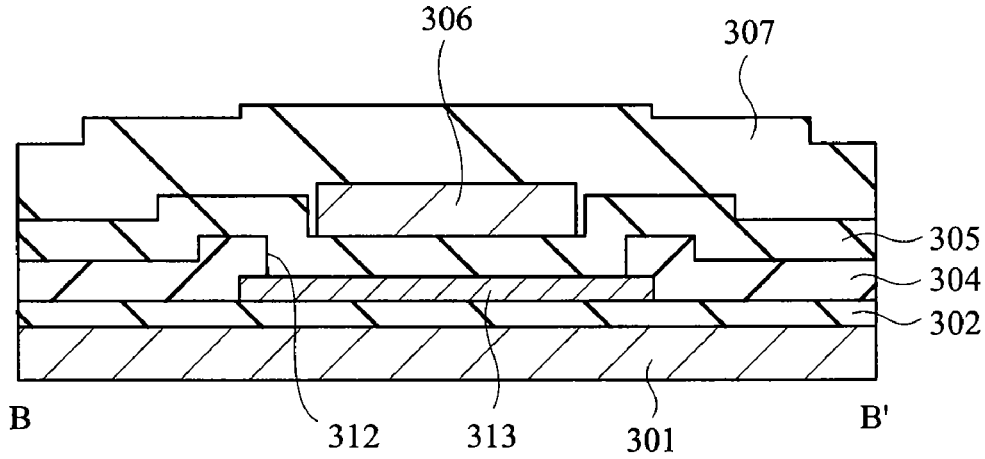
FIG. 8B is a cross-sectional view showing the CMUT cell in the manufacturing process continued from FIG. 7B taken along the line B-B' in FIG. 1.

Next, the insulator 307 formed of a silicon nitride film is deposited to 500 nm by the plasma CVD method so as to cover the insulator 305 and the upper electrode 306 (FIG. 8A and FIG. 8B).

Figure 9A:
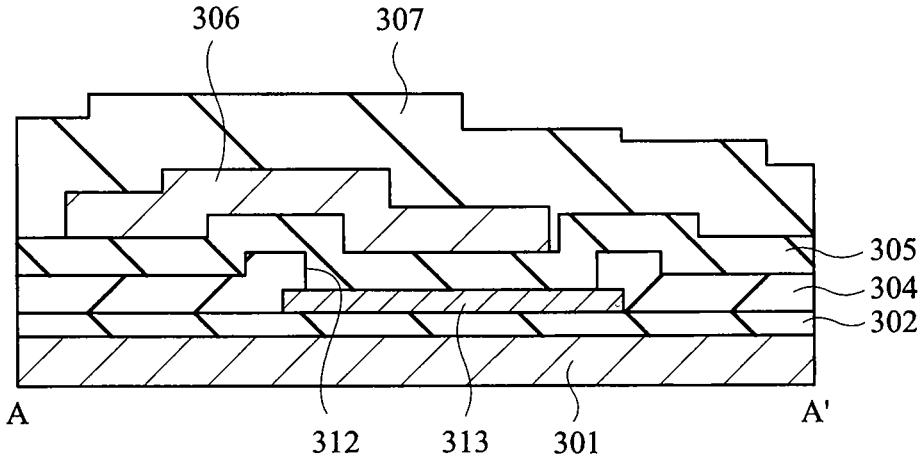
FIG. 9A is a cross-sectional view showing the CMUT cell in the manufacturing process continued from FIG. 8A taken along the line A-A' in FIG. 1.
Figure 9B:
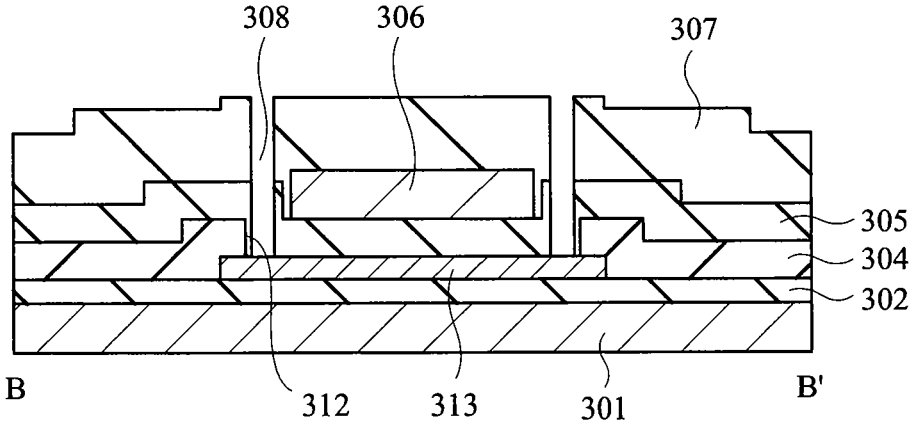
FIG. 9B is a cross-sectional view showing the CMUT cell in the manufacturing process continued from FIG. 8B taken along the line B-B' in FIG. 1.

Subsequently, the wet etching holes 308 that reaches the sacrificial layer 313 are formed in the insulator 307 and the insulator 305 through photolithography process and dry etching process (FIG. 9A and FIG. 9B). The wet etching holes 308 are formed on the inside relative to the side surface 312 of the opening portion of the insulator 304 in FIG. 9. However, it is needless to say that the wet etching hole can be formed on the outside relative to the side surface 312 of the opening portion as long as it reaches the sacrificial layer 313.

Figure 10A:
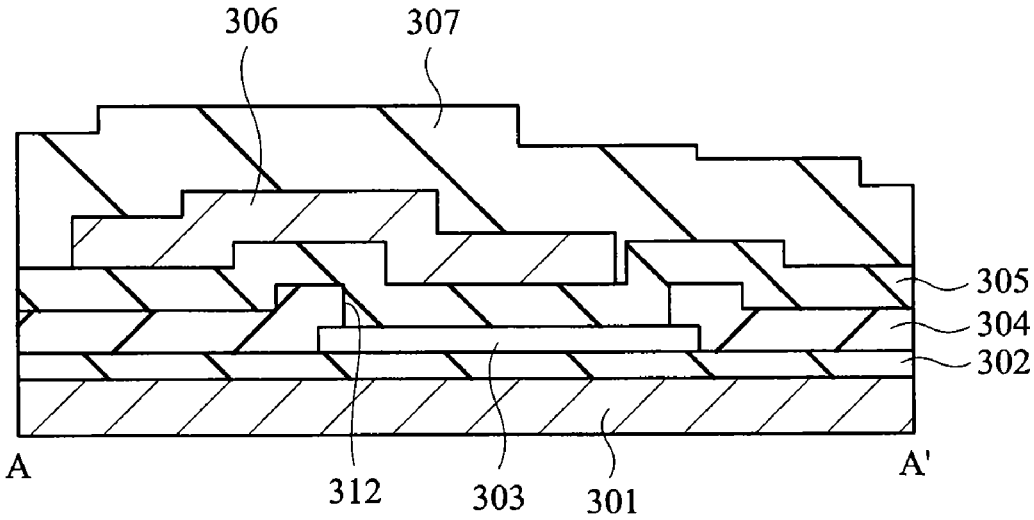
FIG. 10A is a cross-sectional view showing the CMUT cell in the manufacturing process continued from FIG. 9A taken along the line A-A' in FIG. 1.
Figure 10B:
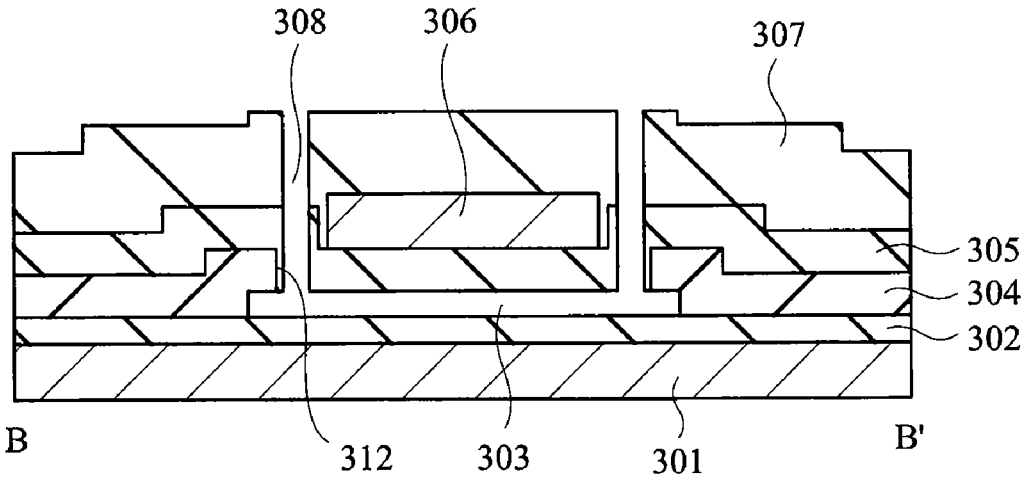
FIG. 10B is a cross-sectional view showing the CMUT cell in the manufacturing process continued from FIG. 9B taken along the line B-B' in FIG. 1.

Thereafter, the sacrificial layer 313 is subjected to the wet etching using potassium hydroxide through the wet etching holes 308, thereby forming the cavity portion 303 (FIG. 10A and FIG. 10B).

Figure 11A:
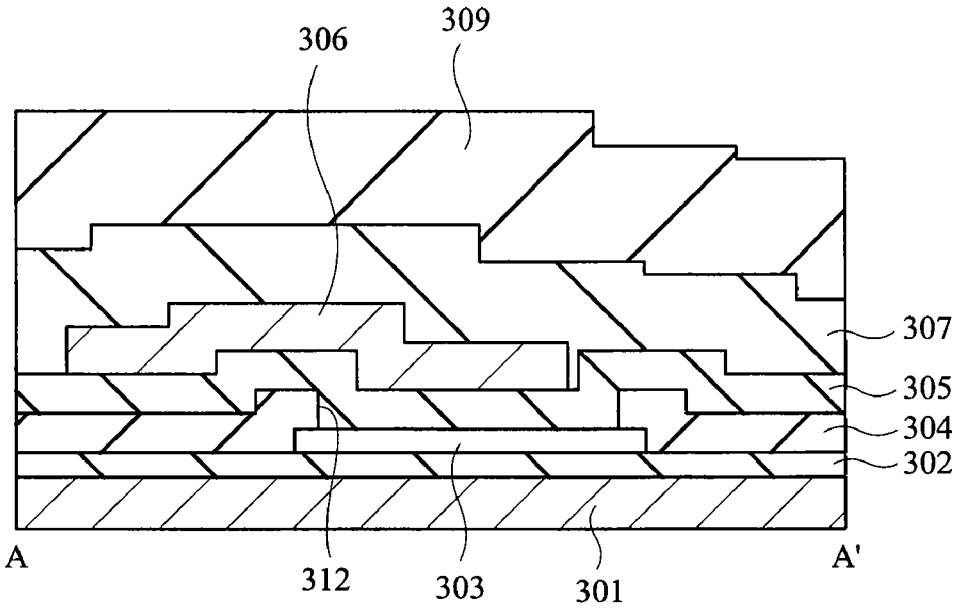
FIG. 11A is a cross-sectional view showing the CMUT cell in the manufacturing process continued from FIG. 10A taken along the line A-A' in FIG. 1.
Figure 11B:
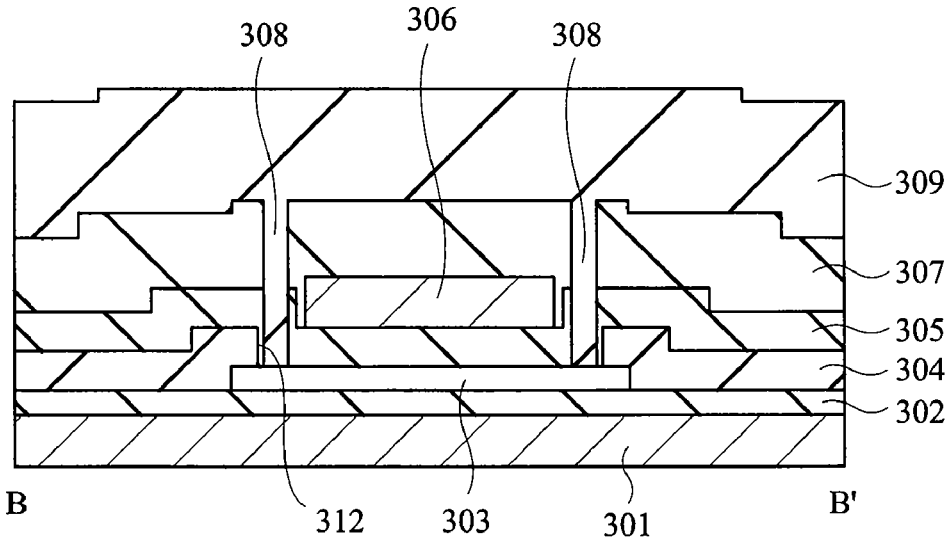
FIG. 11B is a cross-sectional view showing the CMUT cell in the manufacturing process continued from FIG. 10B taken along the line B-B' in FIG. 1.

Next, in order to bury the wet etching holes 308, the insulator 309 formed of a silicon nitride film is deposited to 800 nm by the plasma CVD method (FIG. 11A and FIG. 11B).

Figure 12A:
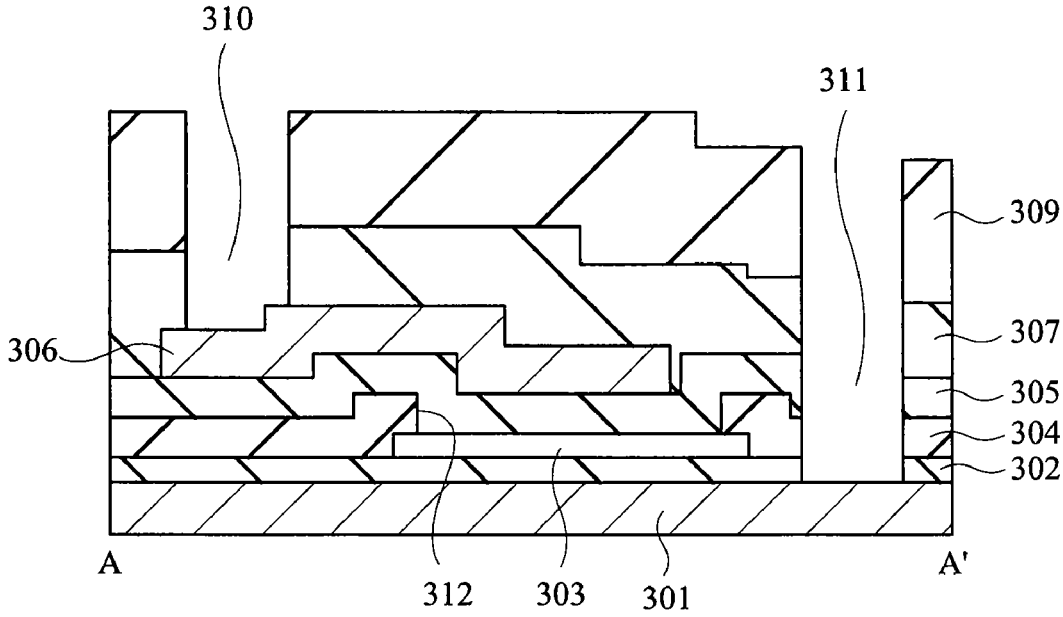
FIG. 12A is a cross-sectional view showing the CMUT cell in the manufacturing process continued from FIG. 11A taken along the line A-A' in FIG. 1.
Figure 12B:
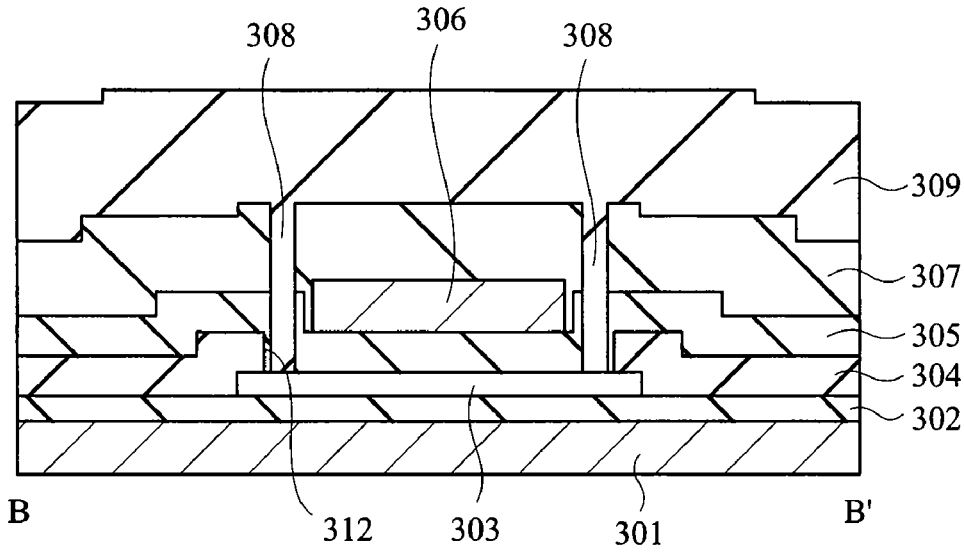
FIG. 12B is a cross-sectional view showing the CMUT cell in the manufacturing process continued from FIG. 11B taken along the line B-B' in FIG. 1.

Then, the opening portion 311 for electrically connecting the lower electrode 301 and the opening portion 310 for electrically connecting the upper electrode 306 are formed through photolithography process and dry etching process (FIG. 12A and FIG. 12B).

In this manner, the CMUT cell according to the first embodiment can be formed.

As described above, in the CMUT cell according to the first embodiment, the thickness of the insulators sandwiched between the lower electrode 301 and the upper electrode 306 in a part not having the cavity portion 303 can be increased by the thickness of the insulator 304 in comparison to that in a part having the cavity portion 303. Therefore, since the space between the lower electrode 301 and the upper electrode 306 in a part having the cavity portion 303 remains unchanged, the amount of change in electric capacitance at the time of receiving ultrasonic waves is not changed, and also, since the thickness of the insulators sandwiched between the lower electrode 301 and the upper electrode 306 in a part not having the cavity portion 303 can be increased, the electric parasitic capacitance can be suppressed. Further, since the thickness of the insulator in the cavity step portion 315 can be increased, the resistance to the electric field concentration at the corner portion of the upper electrode in the step portion 315 can be improved.

Figure 13:
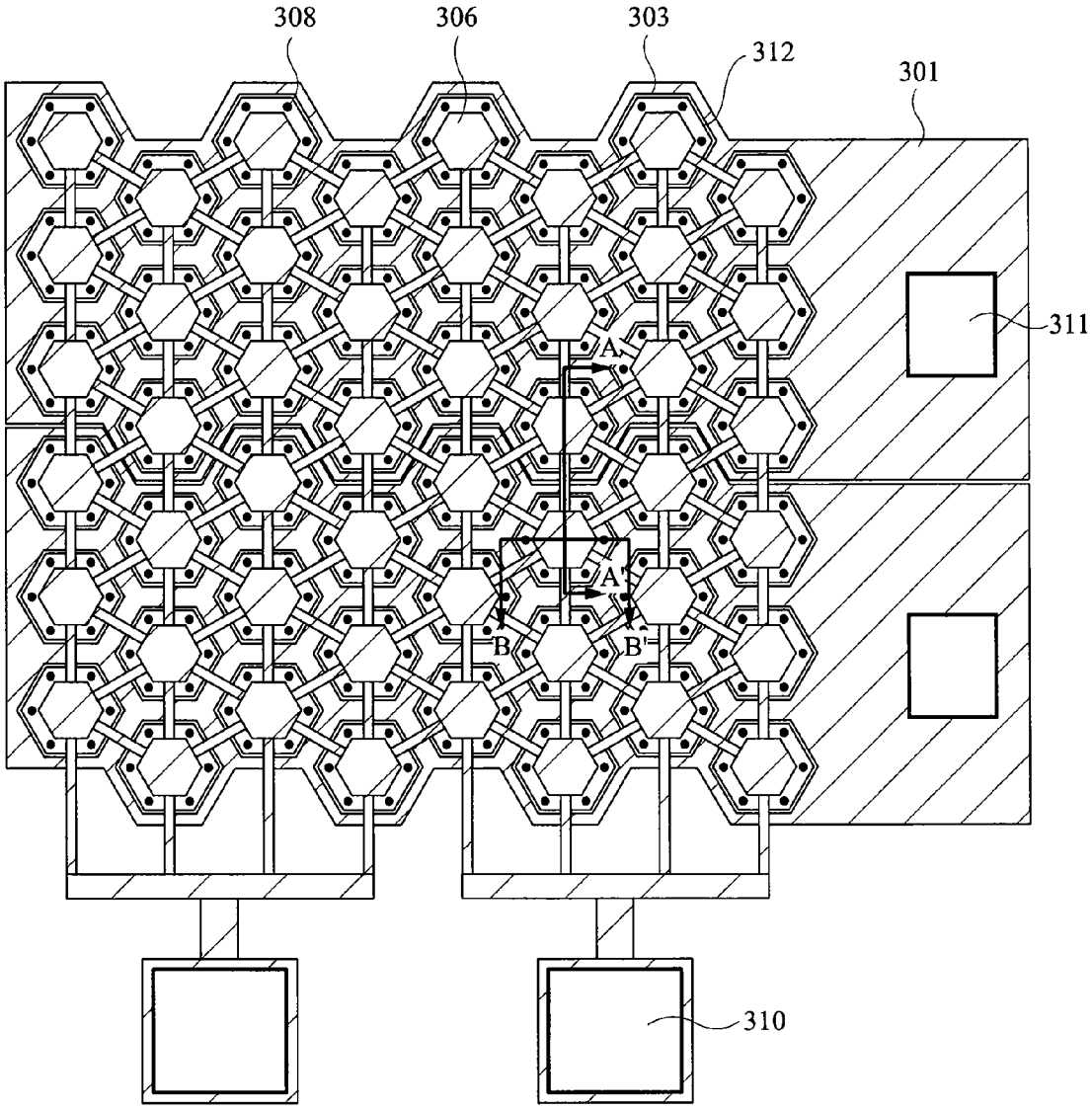
FIG. 13 is a plan view schematically showing the CMUT according to the first embodiment of the present invention.
Figure 14A:
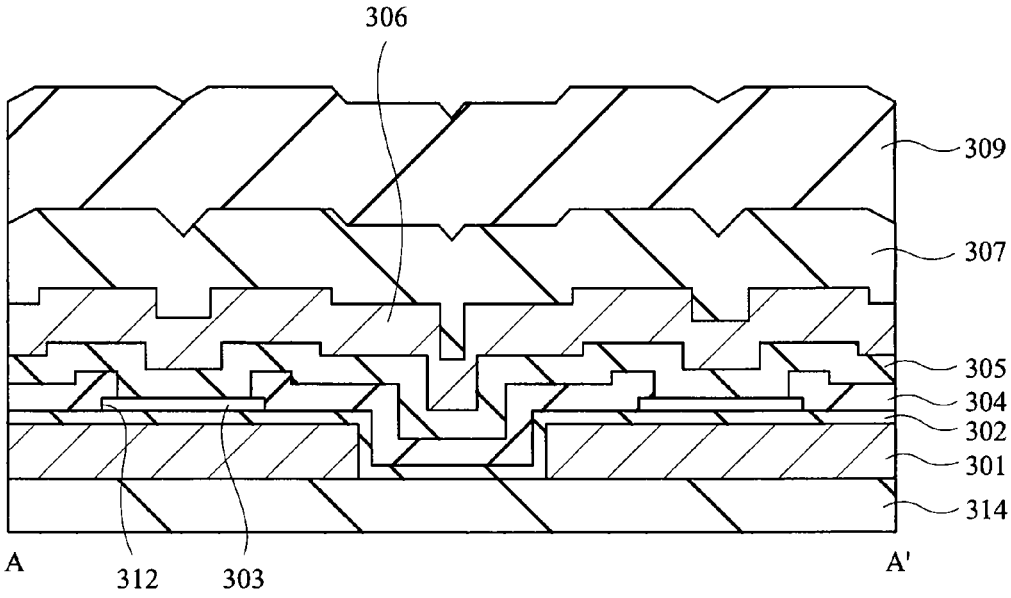
FIG. 14A is a cross-sectional view schematically showing the cross section of the CMUT cell taken along the line A-A' in FIG. 13 according to the first embodiment of the present invention.
Figure 14B:
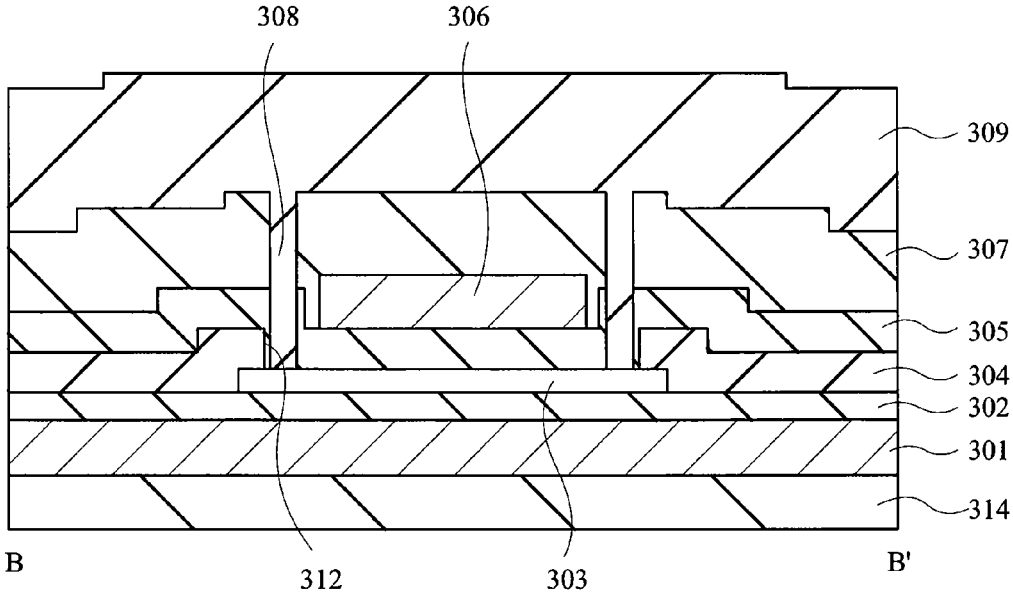
FIG. 14B is a cross-sectional view schematically showing the cross section of the CMUT cell taken along the line B-B' in FIG. 13 according to the first embodiment of the present invention.

Next, the CMUT in which the CMUT cells in the first embodiment are arranged in an array will be described with reference to FIG. 13 and FIG. 14. Although the CMUT cell shown in FIG. 1 and others is in the form of a single CMUT cell, even in the case where the CMUT cells are arranged in an array and the lower electrode thereof is divided, the CMUT cell has the same structure. FIG. 13 is a top view showing the case where the three-row, four-column CMUT arrays are disposed at a cross point between the lower electrode 301 and the upper electrode 306. FIG. 14A is a cross-sectional view taken along the line A-A' in FIG. 13 and FIG. 14B is a cross-sectional view taken along the line B-B' in FIG. 13. The reference numerals denoting each component in FIG. 13 and FIG. 14 are equivalent to those used in FIG. 1 to FIG. 12. In FIG. 14, a reference numeral 314 denotes an insulator and it serves as a foundation layer of the lower electrode 301.

Also in this case, the thickness of the insulators sandwiched between the lower electrode 301 and the upper electrode 306 in a part not having the cavity portion 303 can be increased by the thickness of the insulator 304 in comparison to that in a part having the cavity portion 303. Therefore, since the space between the lower electrode 301 and the upper electrode 306 in a part having the cavity portion 303 remains unchanged, the amount of change in electric capacitance at the time of receiving ultrasonic waves is not changed, and also, since the thickness of the insulators sandwiched between the lower electrode 301 and the upper electrode 306 in a part not having the cavity portion 303 can be increased, the electric parasitic capacitance can be suppressed. Further, since the thickness of the insulator in the cavity step portion 315 can be increased, the resistance to the electric field concentration at the corner portion of the upper electrode in the step portion 315 can be improved.

Note that, although the CMUT cell has a hexagonal planar shape in FIG. 1 and FIG. 13, the shape of the CMUT cell is not restricted to this, and other shape such as circular shape and rectangular shape is also applicable.

Also, the materials for forming the CMUT cell described in the first embodiment are shown as a mere example of the combination thereof. Any material can be used for the material of the sacrificial layer as long as the wet etching selectivity to the material surrounding the sacrificial layer can be sufficiently ensured. Therefore, other than a polycrystalline silicon film, an SOG (Spin-on-Glass) film or a metal film is also available.

Further, any conductive film can be used for the lower electrode of the CMUT, and it is obvious that any of a semiconductor substrate, a conductive film on an insulator formed on a semiconductor substrate as shown in FIG. 14 and a conductive film on a semiconductor substrate on which signal processing circuits are formed is also available.

Second Embodiment

Figure 15:
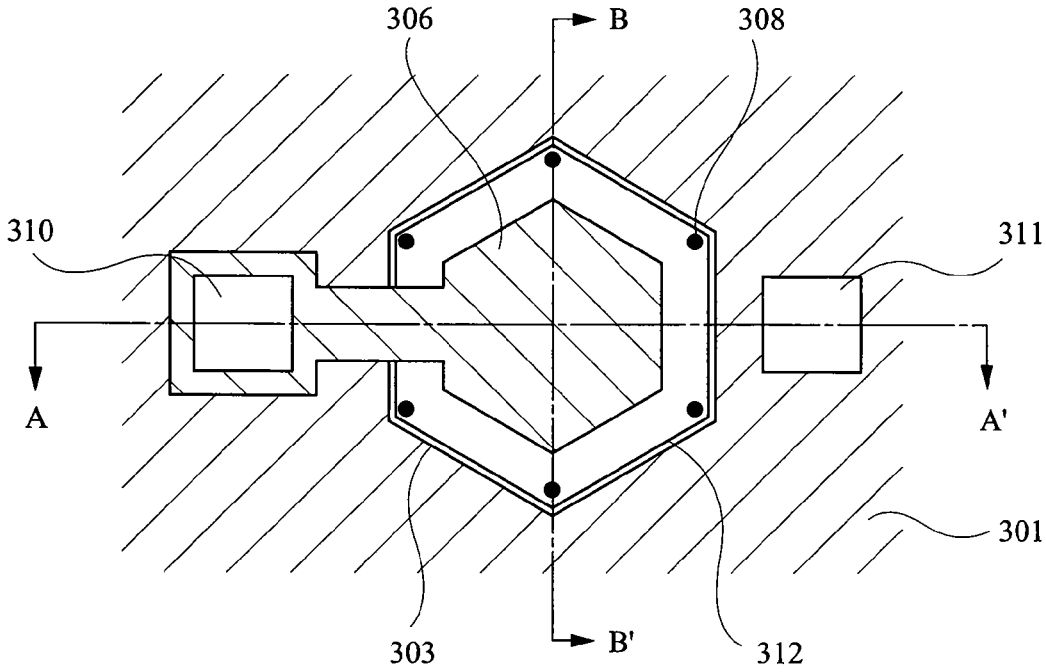
FIG. 15 is a plan view schematically showing the CMUT cell according to the second embodiment of the present invention.
Figure 16A:
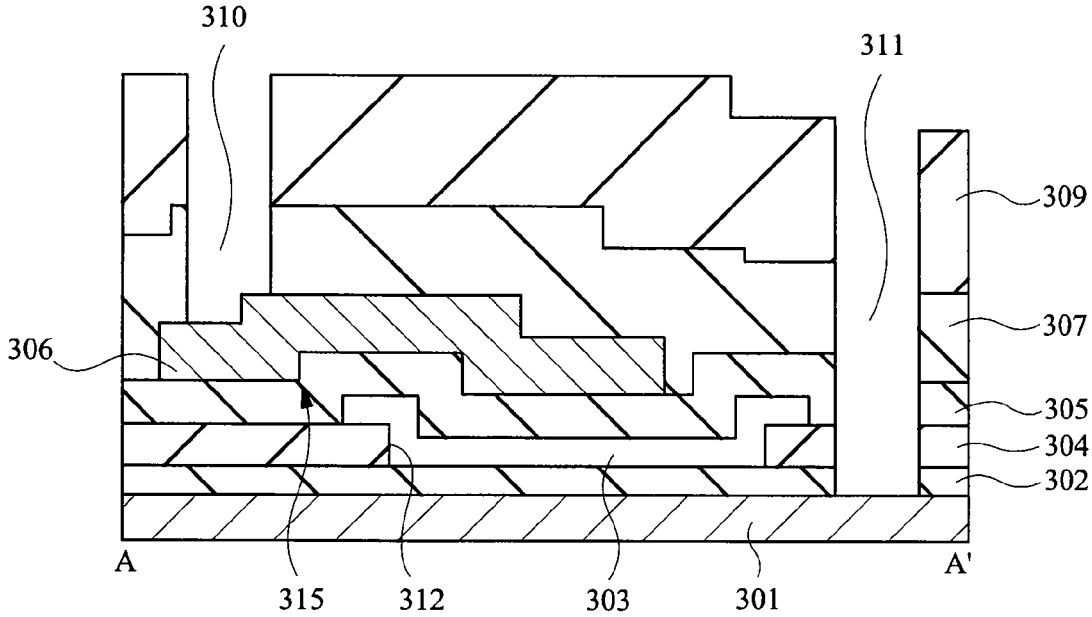
FIG. 16A is a cross-sectional view schematically showing the cross section of the CMUT cell taken along the line A-A' in FIG. 15 according to the second embodiment of the present invention.
Figure 16B:
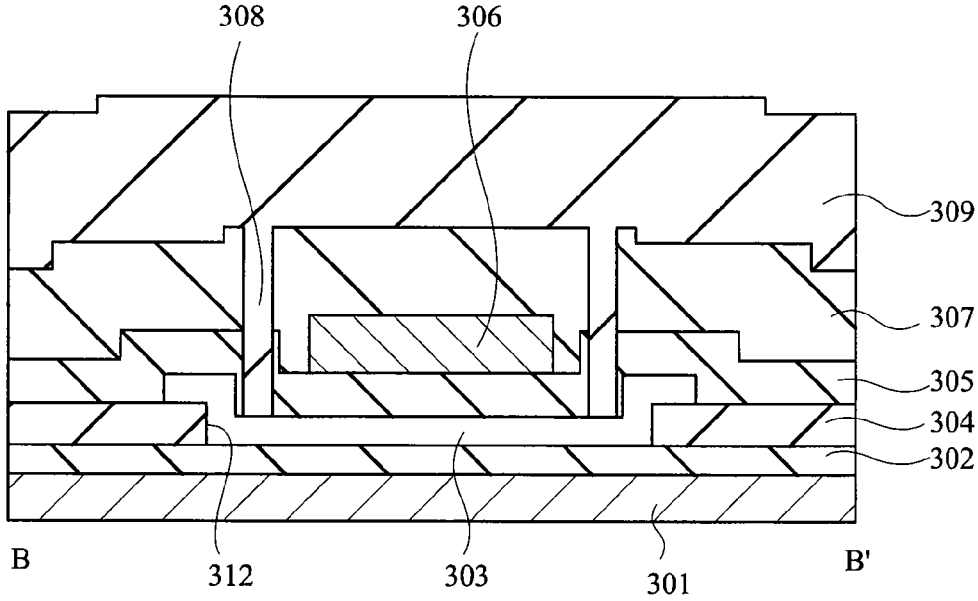
FIG. 16B is a cross-sectional view schematically showing the cross section of the CMUT cell taken along the line B-B' in FIG. 15 according to the second embodiment of the present invention.

First, a structure of a CMUT cell according to the second embodiment of the present invention will be described with reference to FIG. 15 and FIG. 16. FIG. 15 is a plan view schematically showing an upper surface of the CMUT cell, and FIG. 16A and FIG. 16B are cross-sectional views schematically showing the CMUT cell, in which FIG. 16A shows a cross section taken along the line A-A' in FIG. 15 and FIG. 16B shows a cross section taken along the line B-B' in FIG. 15.

In FIG. 15 and FIG. 16, a reference numeral 301 denotes a lower electrode, 302, 304, 305, 307 and 309 denote insulators, 303 denotes a cavity portion, 306 denotes an upper electrode, and 308 denotes a wet etching hole for forming the cavity portion 303. More specifically, the wet etching hole 308 is connected to the cavity portion 303. Further, a reference numeral 310 denotes a pad opening portion for supplying power to the upper electrode 306, and a reference numeral 311 denotes a pad opening portion for supplying power to the lower electrode 301. Note that, in FIG. 15, the insulators 305, 307 and 309 are not illustrated in order to show the cavity portion 303 and the upper electrode 306. For the same reason, the insulator 304 is not illustrated, but a side surface 312 of the opening portion is illustrated in order to show the positional relation of the opening of the insulator 304. Further, a membrane of the CMUT cell in the second embodiment is constituted of the insulators 305, 307 and 309 and the upper electrode 306.

In the CMUT cell according to the second embodiment, as shown in FIG. 15 and FIG. 16, the insulator 304 having an opening portion whose diameter is smaller than the cavity portion 303 is inserted below the cavity portion 303, thereby increasing the thickness of the insulators between electrodes in a part not having the cavity portion 303. In this structure, since the space between electrodes in a part having the cavity portion 303 and the space between electrodes in a part not having the cavity portion 303 can be controlled independently, the thickness of the insulators sandwiched between the lower electrode 301 and the upper electrode 306 in a part not having the cavity portion 303 can be increased without increasing the space between the lower electrode 301 and the upper electrode 306 in a part having the cavity portion 303. Therefore, the decrease in the receiver sensitivity can be suppressed and the withstand voltage can be improved. More specifically, since the space between electrodes in a part having the cavity portion 303 remains unchanged, the amount of change in electric capacitance at the time of receiving ultrasonic waves is not changed, and also, since the thickness of the insulators sandwiched between electrodes in a part not having the cavity portion 303 can be increased, the electric parasitic capacitance can be suppressed. Further, since the thickness of the insulator in the cavity step portion 315 can be increased, the resistance to the electric field concentration at the corner portion of the upper electrode 306 in the step portion 315 can be improved.

Also, in the second embodiment, the cavity portion 303 has step portions as shown in FIG. 16. In this case, the membrane has a ridge portion in an end portion of the cavity portion 303. When transmitting and receiving the ultrasonic waves, this ridge portion (end portion of the cavity portion 303 in the second embodiment) functions as a spring, and the average amplitude on the whole surface of the membrane can be increased.

Next, the operation of the CMUT cell according to the second embodiment of the present invention will be described with reference to FIG. 17. FIG. 17 shows the case where the ridge portion is not formed at the end portion of the cavity portion 303 (FIG. 17A and FIG. 17B) and the case of the second embodiment where the ridge portion is formed at the end portion thereof (FIG. 17C and FIG. 17D). Further, FIG. 17A and FIG. 17C show the state where the ultrasonic waves are not transmitted and received, and FIG. 17B and FIG. 17D show the state where the ultrasonic waves are transmitted and received and the amplitude of the membrane is maximum. Note that the insulators on the upper electrode 306 that are shown in FIG. 16 are omitted in FIG. 17.

In the case where the ridge portion is not formed at the end portion of the cavity portion 303 (FIG. 17A and FIG. 17B), the amplitude of the membrane becomes maximum at the center of the cavity portion 303 when viewed from the top, and the amplitude gradually decreases as it comes close to the end portion of the cavity portion 303. Accordingly, the amount of change in distance between the upper electrode 306 and the lower electrode 301 at the time of vibration of the membrane also decreases as it comes close to the end portion of the cavity portion 303.

On the other hand, in the case where the ridge portion is formed at the end portion of the cavity portion 303 (FIG. 17C and FIG. 17D), since the ridge portion functions as a spring, the amplitude of the membrane can have a value close to the maximum one even at the end portion of the cavity portion 303. Therefore, the amount of change in distance between the upper electrode 306 and the lower electrode 301 at the time of vibration of the membrane does not decrease as it comes close to the end portion of the cavity portion 303. In other words, the average amplitude on the whole surface of the membrane can be increased, and the efficiency at the time of transmitting and receiving ultrasonic waves can be improved.

Figure 18A:
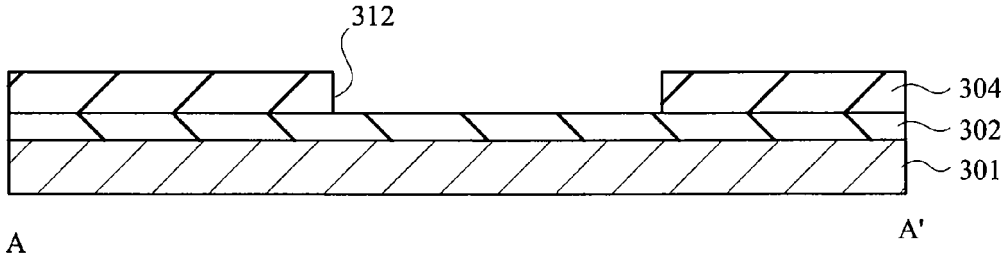
FIG. 18A is a cross-sectional view showing the CMUT cell in the manufacturing process taken along the line A-A' in FIG. 15 according to the second embodiment of the present invention.
Figure 18B:
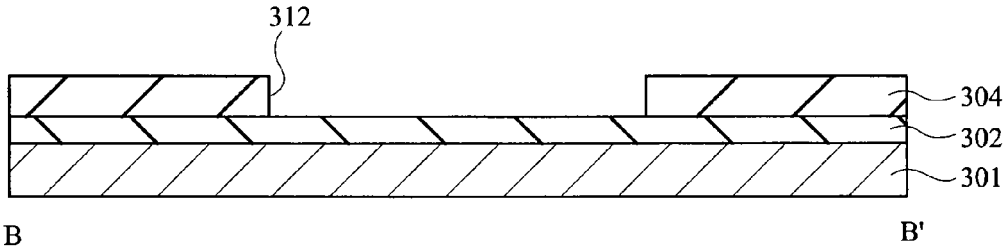
FIG. 18B is a cross-sectional view showing the CMUT cell in the manufacturing process taken along the line B-B' in FIG. 15 according to the second embodiment of the present invention.
Figure 19A:
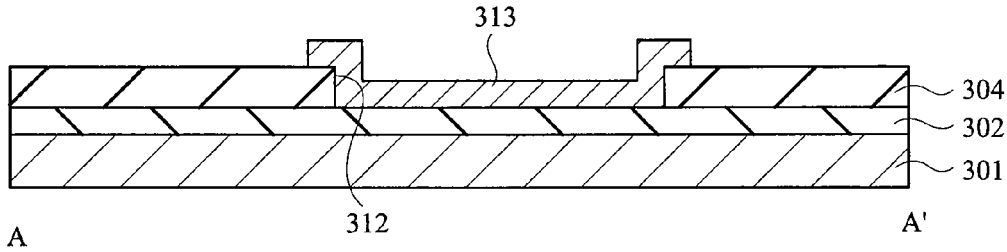
FIG. 19A is a cross-sectional view showing the CMUT cell in the manufacturing process continued from FIG. 18A taken along the line A-A' in FIG. 15.
Figure 19B:
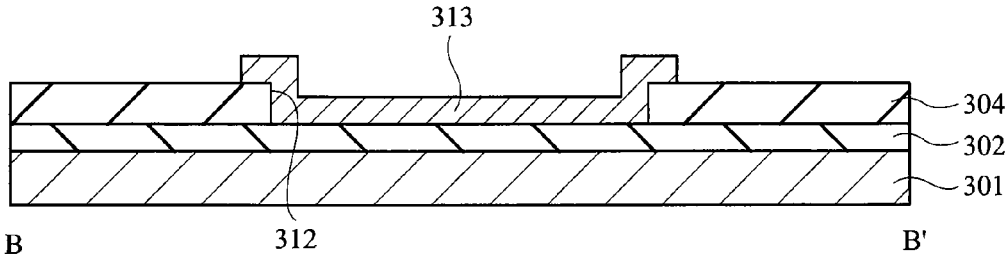
FIG. 19B is a cross-sectional view showing the CMUT cell in the manufacturing process continued from FIG. 18B taken along the line B-B' in FIG. 15.
Figure 20A:
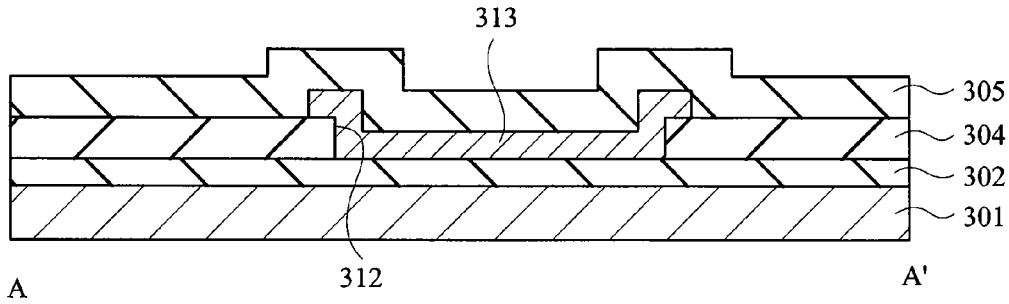
FIG. 20A is a cross-sectional view showing the CMUT cell in the manufacturing process continued from FIG. 19A taken along the line A-A' in FIG. 15.
Figure 20B:
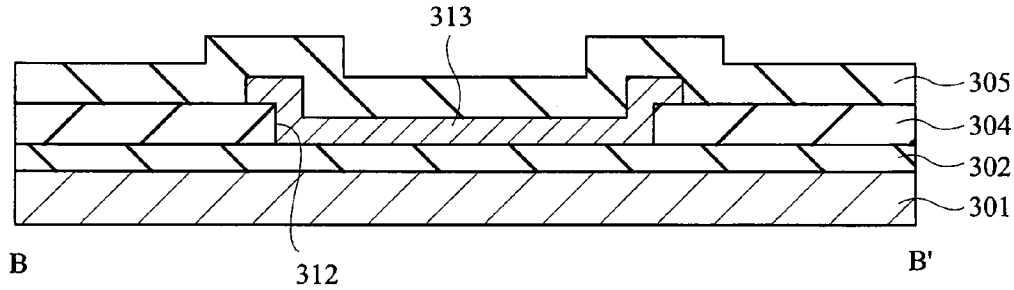
FIG. 20B is a cross-sectional view showing the CMUT cell in the manufacturing process continued from FIG. 19B taken along the line B-B' in FIG. 15.

Next, the manufacturing method of the CMUT cell using the MEMS technology according to the second embodiment of the present invention will be described with reference to FIG. 18 to FIG. 20. FIG. 18 to FIG. 20 are cross-sectional views schematically showing the CMUT cell in the manufacturing process, in which FIG. 18A to FIG. 20A show the cross sections taken along the line A-A' in FIG. 15 and FIG. 18B to FIG. 20B show the cross sections taken along the line B-B' in FIG. 15.

First, as shown in FIG. 18A and FIG. 18B, the insulator 302 formed of a silicon oxide film is deposited to 100 nm on the lower electrode 301 formed of a conductive film by the plasma CVD method, and then, the insulator 304 formed of a silicon oxide film is deposited to 200 nm by the plasma CVD method so as to cover the insulator 302. Next, an opening portion that reaches the insulator 302 is formed in the insulator 304 through photolithography process and dry etching process.

Next, a polycrystalline silicon film is deposited to 100 nm on the insulator 302 and the insulator 304 by the plasma CVD method. Then, the polycrystalline silicon film is patterned and left through photolithography process and dry etching process so as to cover the opening portion of the insulator 304. The left part of the film is the sacrificial layer 313, and it turns to the cavity portion 303 in the subsequent process (FIG. 19A and FIG. 19B).

Then, the insulator 305 formed of a silicon oxide film is deposited to 200 nm by the plasma CVD method so as to cover the sacrificial layer 313 and the insulator 304 (FIG. 20A and FIG. 20B). Since the following manufacturing method is the same as that described in the first embodiment shown in FIG. 7 to FIG. 12, the description thereof is omitted here.

When the opening portion is formed in the insulator 304, the insulator 302 serves as an etching stopper layer thereof. In this case, if the insulator 304 and the insulator 302 are made of the same material, the insulator 302 to be the etching stopper layer is likely to be thinned due to the overetching in the etching for forming the opening portion. When the insulator 302 is thinned, the electric capacitance between the lower electrode 301 and the upper electrode 306 in a part having the cavity portion 303 deviates from its design value, and it causes the variation in electric capacitance of the CMUT cell. Accordingly, in the case shown in FIG. 18 to FIG. 20, instead of a silicon oxide film used as the material of the insulator 304 and the insulator 302, for example, a silicon oxide film and a silicon nitride film are used for the insulator 304 and the insulator 302, respectively. By this means, the amount of the insulator 302 to be thinned due to the overetching in the etching for forming the opening portion of the insulator 304 can be reduced.

Also in the case where the single CMUT cells in the second embodiment are arranged in an array and the lower electrode thereof is divided, the same effects as those described in the first embodiment can be achieved.

Note that, although the CMUT cell has a hexagonal planar shape in FIG. 15, the shape of the CMUT cell is not restricted to this, and other shape such as circular shape and rectangular shape is also applicable.

Also, the materials for forming the CMUT cell described in the second embodiment are shown as a mere example of the combination thereof. Any material can be used for the material of the sacrificial layer as long as the wet etching selectivity to the material surrounding the sacrificial layer can be sufficiently ensured. Therefore, other than a polycrystalline silicon film, an SOG (Spin-on-Glass) film or a metal film is also available.

Further, any conductive film can be used for the lower electrode of the CMUT, and it is obvious that any of a semiconductor substrate, a conductive film on an insulator formed on a semiconductor substrate and a conductive film on a semiconductor substrate on which signal processing circuits are formed is also available.

Third Embodiment

Figure 21:
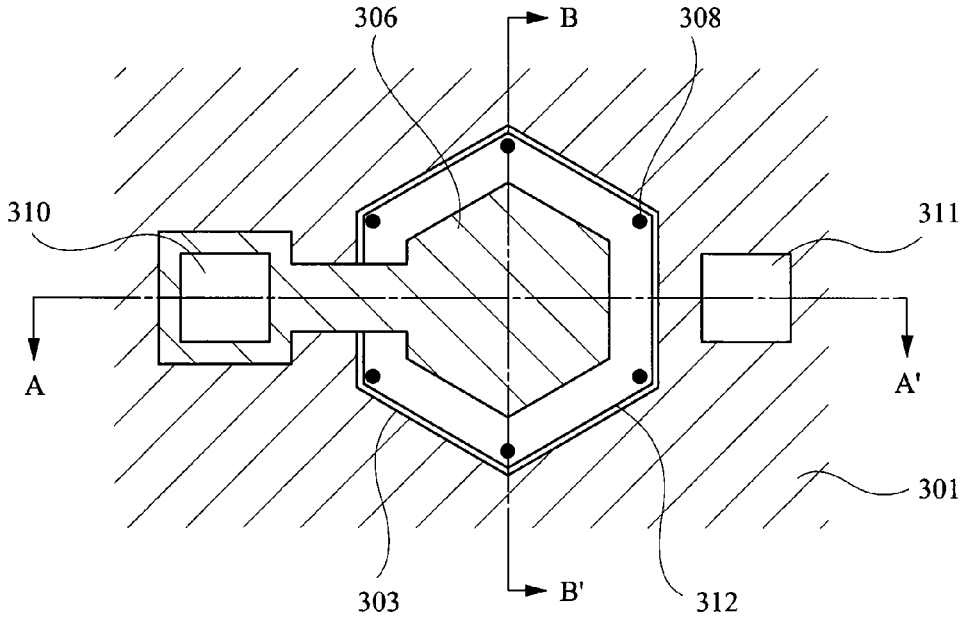
FIG. 21 is a plan view schematically showing the CMUT cell according to the third embodiment of the present invention.
Figure 22A:
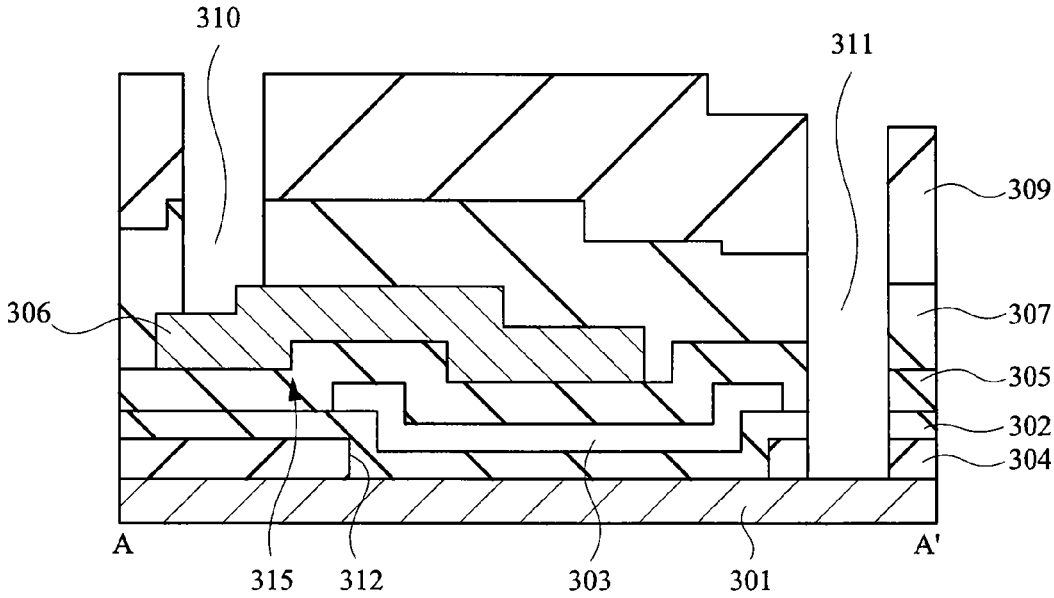
FIG. 22A is a cross-sectional view schematically showing the cross section of the CMUT cell taken along the line A-A' in FIG. 21 according to the third embodiment of the present invention.
Figure 22B:
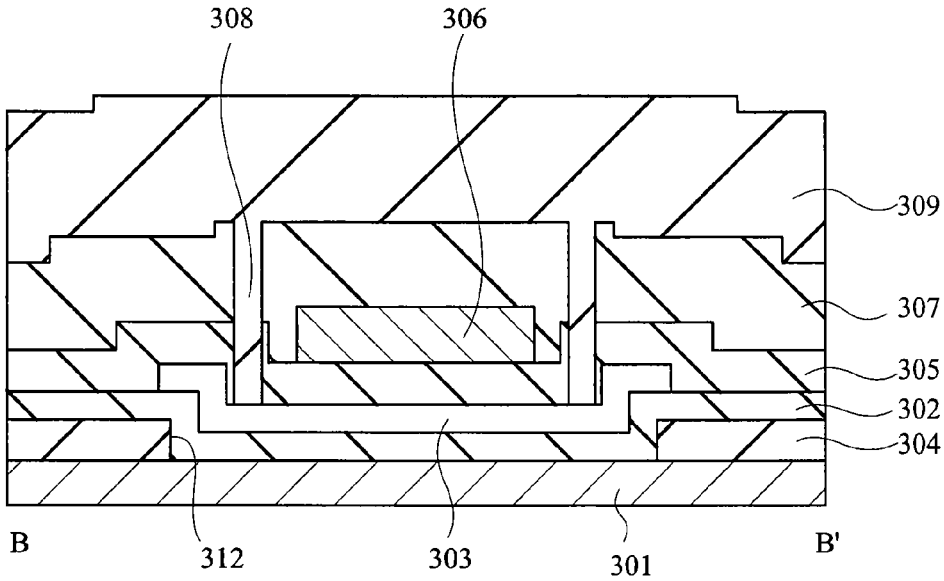
FIG. 22B is a cross-sectional view schematically showing the cross section of the CMUT cell taken along the line B-B' in FIG. 21 according to the third embodiment of the present invention.

First, a structure of a CMUT cell according to the third embodiment of the present invention will be described with reference to FIG. 21 and FIG. 22. FIG. 21 is a plan view schematically showing an upper surface of the CMUT cell, and FIG. 22A and FIG. 22B are cross-sectional views schematically showing the CMUT cell, in which FIG. 22A shows a cross section taken along the line A-A' in FIG. 21 and FIG. 22B shows a cross section taken along the line B-B' in FIG. 21.

In FIG. 21 and FIG. 22, a reference numeral 301 denotes a lower electrode, 302, 304, 305, 307 and 309 denote insulators, 303 denotes a cavity portion, 306 denotes an upper electrode, and 308 denotes a wet etching hole for forming the cavity portion 303. More specifically, the wet etching hole 308 is connected to the cavity portion 303. Further, a reference numeral 310 denotes a pad opening portion for supplying power to the upper electrode 306, and a reference numeral 311 denotes a pad opening portion for supplying power to the lower electrode 301. Note that, in FIG. 21, the insulators 305, 307 and 309 are not illustrated in order to show the cavity portion 303 and the upper electrode 306. For the same reason, the insulator 304 is not illustrated, but a side surface 312 of the opening portion is illustrated in order to show the positional relation of the opening of the insulator 304. Further, a membrane of the CMUT cell in the third embodiment is constituted of the insulators 305, 307 and 309 and the upper electrode 306.

In the CMUT cell according to the third embodiment, as shown in FIG. 21 and FIG. 22, the insulator 304 having an opening portion whose diameter is smaller than the cavity portion 303 is inserted below the cavity portion 303, thereby increasing the thickness of the insulator between electrodes in a part not having the cavity portion 303. In this structure, since the space between electrodes in a part having the cavity portion 303 and the space between electrodes in a part not having the cavity portion 303 can be controlled independently, the thickness of the insulators sandwiched between the lower electrode 301 and the upper electrode 306 in a part not having the cavity portion 303 can be increased without increasing the space between the lower electrode 301 and the upper electrode 306 in a part having the cavity portion 303. Therefore, the decrease in the receiver sensitivity can be suppressed and the withstand voltage can be improved. More specifically, since the space between electrodes in a part having the cavity portion 303 remains unchanged, the amount of change in electric capacitance at the time of receiving ultrasonic waves is not changed, and also, since the thickness of the insulators sandwiched between electrodes in a part not having the cavity portion 303 can be increased, the electric parasitic capacitance can be suppressed. Further, since the thickness of the insulator in the cavity step portion 315 can be increased, the resistance to the electric field concentration at the corner portion of the upper electrode in the step portion 315 can be improved.

Also, although the insulator 302 serves as an etching stopper layer in forming the opening portion of the insulator 304 in the second embodiment described above, the lower electrode serves as an etching stopper layer in forming the opening portion of the insulator 304 in the third embodiment. Therefore, the etching stopper layer for forming the opening portion of the insulator 304 is made of a material different from that of the insulator 304, and the lower electrode 301 serving as the etching stopper layer is hardly thinned by the overetching in the etching for forming the opening portion of the insulator 304. Further, in the third embodiment, since the insulator between the lower electrode 301 and the upper electrode 306 in a part having the cavity portion 303 is not exposed to the etching for forming the opening portion of the insulator 304, the thickness thereof is not reduced, and thus, the variation in the electric capacitance can be suppressed.

Also, in the third embodiment, the cavity portion 303 has a step portion as shown in FIG. 22. In this case, similar to the second embodiment, the membrane has a ridge portion in an end portion of the cavity portion 303. When transmitting and receiving the ultrasonic waves, this ridge portion functions as a spring, and the average amplitude on the whole surface of the membrane can be increased.

Figure 23A:
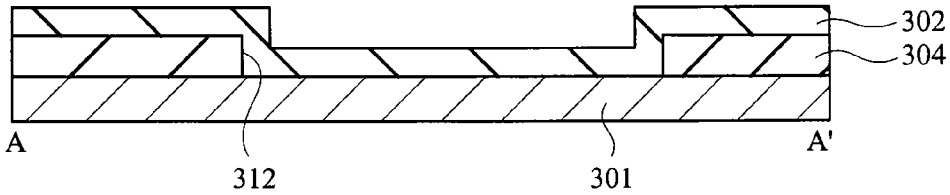
FIG. 23A is a cross-sectional view showing the CMUT cell in the manufacturing process taken along the line A-A' in FIG. 21 according to the third embodiment of the present invention.
Figure 23B:
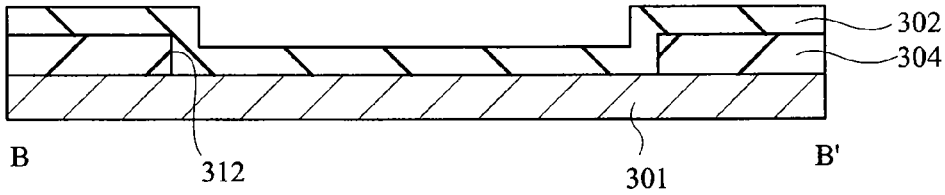
FIG. 23B is a cross-sectional view showing the CMUT cell in the manufacturing process taken along the line B-B' in FIG. 21 according to the third embodiment of the present invention.
Figure 24A:
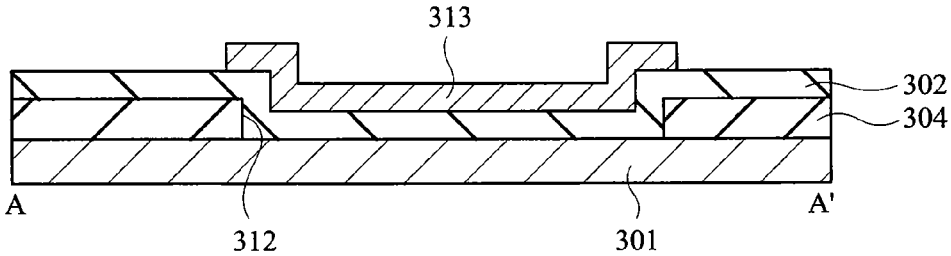
FIG. 24A is a cross-sectional view showing the CMUT cell in the manufacturing process continued from FIG. 23A taken along the line A-A' in FIG. 21.
Figure 24B:
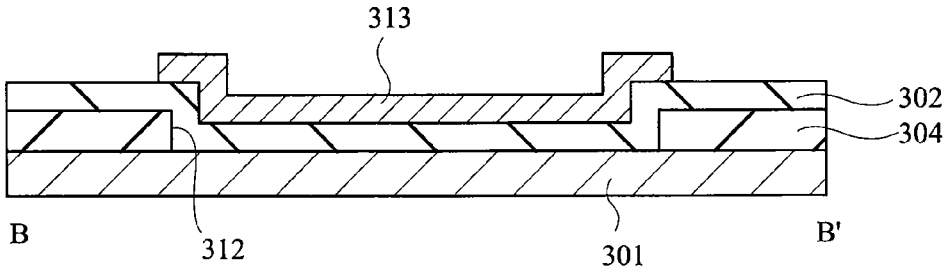
FIG. 24B is a cross-sectional view showing the CMUT cell in the manufacturing process continued from FIG. 23B taken along the line B-B' in FIG. 21.
Figure 25A:
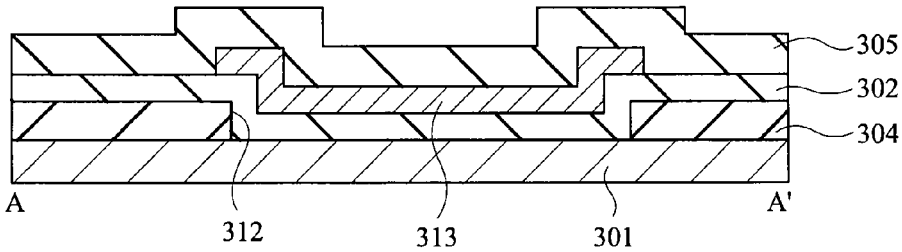
FIG. 25A is a cross-sectional view showing the CMUT cell in the manufacturing process continued from FIG. 24A taken along the line A-A' in FIG. 21.
Figure 25B:
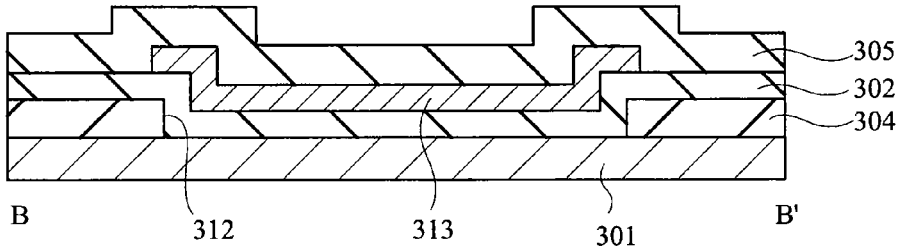
FIG. 25B is a cross-sectional view showing the CMUT cell in the manufacturing process continued from FIG. 24B taken along the line B-B' in FIG. 21.

Next, the manufacturing method of the CMUT cell using the MEMS technology according to the third embodiment of the present invention will be described with reference to FIG. 23 to FIG. 25. FIG. 23 to FIG. 25 are cross-sectional views schematically showing the CMUT cell in the manufacturing process, in which FIG. 23A to FIG. 25A show the cross sections taken along the line A-A' in FIG. 21 and FIG. 23B to FIG. 25B show the cross sections taken along the line B-B' in FIG. 21.

First, as shown in FIG. 23A and FIG. 23B, the insulator 304 formed of a silicon oxide film is deposited to 200 nm on the lower electrode 301 formed of a conductive film by the plasma CVD (Chemical Vapor Deposition) method, and then, an opening portion that reaches the lower electrode 301 is formed in the insulator 304 through photolithography process and dry etching process.

Subsequently, the insulator 302 formed of a silicon oxide film is deposited to 100 nm by the plasma CVD method so as to cover the insulator 304 and the lower electrode 301.

Next, a polycrystalline silicon film is deposited to 100 nm on the insulator 302 by the plasma CVD method. Then, the polycrystalline silicon film is patterned and left through photolithography process and dry etching process so as to cover the opening portion of the insulator 304. The left part of the film is the sacrificial layer 313, and it turns to the cavity portion 303 in the subsequent process (FIG. 24A and FIG. 24B).

Then, the insulator 305 formed of a silicon oxide film is deposited to 200 nm by the plasma CVD method so as to cover the sacrificial layer 313 and the insulator 302 (FIG. 25A and FIG. 25B). Since the following manufacturing method is the same as that described in the first embodiment shown in FIG. 7 to FIG. 12, the description thereof is omitted here.

Also in the case where the single CMUT cells in the third embodiment are arranged in an array and the lower electrode thereof is divided, the same effects as those described in the first embodiment can be achieved.

Note that, although the CMUT cell has a hexagonal planar shape in FIG. 21, the shape of the CMUT cell is not restricted to this, and other shape such as circular shape and rectangular shape is also applicable.

Also, the materials for forming the CMUT cell described in the third embodiment are shown as a mere example of the combination thereof. Any material can be used for the material of the sacrificial layer as long as the wet etching selectivity to the material surrounding the sacrificial layer can be sufficiently ensured. Therefore, other than a polycrystalline silicon film, an SOG (Spin-on-Glass) film or a metal film is also available.

Further, any conductive film can be used for the lower electrode of the CMUT, and it is obvious that any of a semiconductor substrate, a conductive film on an insulator formed on a semiconductor substrate and a conductive film on a semiconductor substrate on which signal processing circuits are formed is also available.

Fourth Embodiment

Figure 26:
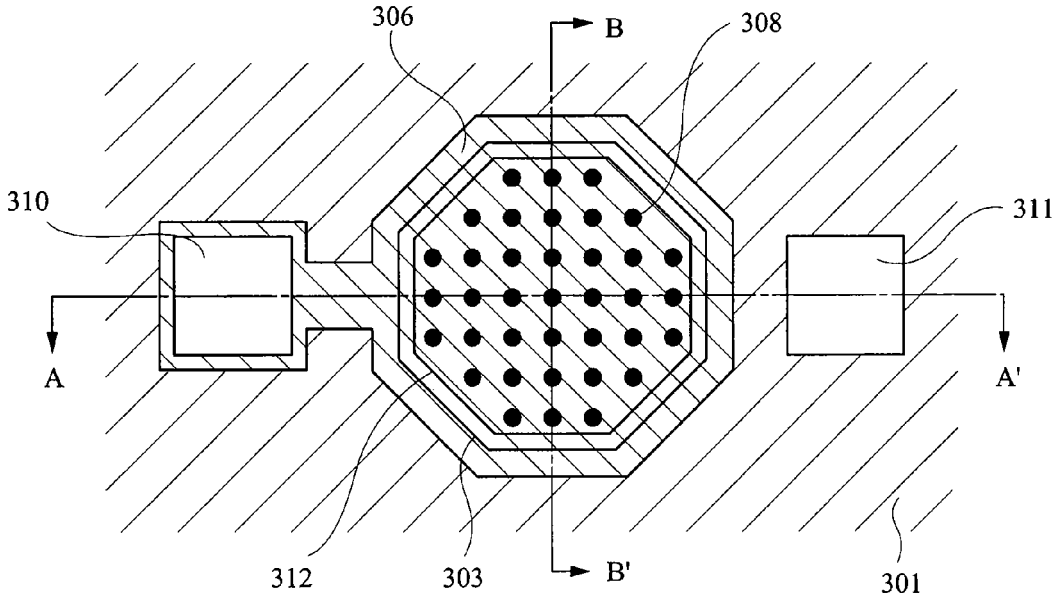
FIG. 26 is a plan view schematically showing the CMUT cell according to the fourth embodiment of the present invention.
Figure 27A:
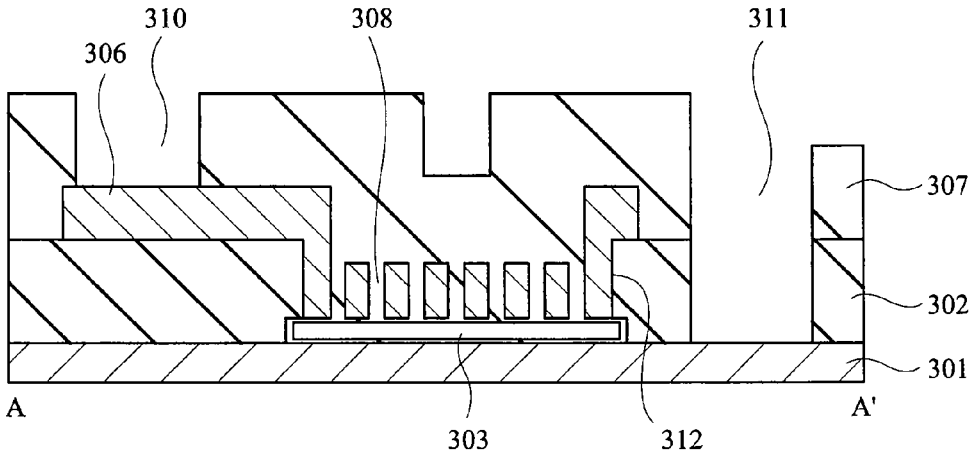
FIG. 27A is a cross-sectional view schematically showing the cross section of the CMUT cell taken along the line A-A' in FIG. 26 according to the fourth embodiment of the present invention.
Figure 27B:
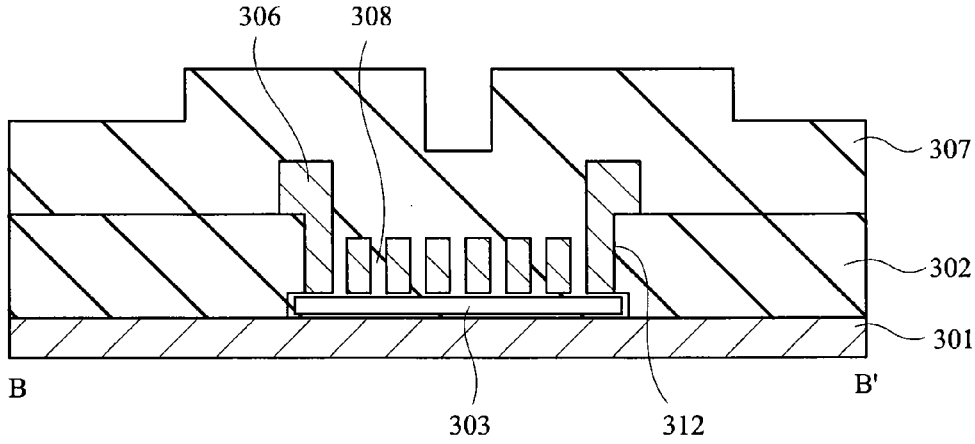
FIG. 27B is a cross-sectional view schematically showing the cross section of the CMUT cell taken along the line B-B' in FIG. 26 according to the fourth embodiment of the present invention.

First, a structure of a CMUT cell according to the fourth embodiment of the present invention will be described with reference to FIG. 26 and FIG. 27. FIG. 26 is a plan view schematically showing an upper surface of the CMUT cell, and FIG. 27A and FIG. 27B are cross-sectional views schematically showing the CMUT cell, in which FIG. 27A shows a cross section taken along the line A-A' in FIG. 26 and FIG. 27B shows a cross section taken along the line B-B' in FIG. 26.

In FIG. 26 and FIG. 27, a reference numeral 301 denotes a lower electrode, 302 and 307 denote insulators, 303 denotes a cavity portion, 306 denotes an upper electrode, and 308 denotes a wet etching hole for forming the cavity portion 303. More specifically, the wet etching hole 308 is connected to the cavity portion 303. Further, a reference numeral 310 denotes a pad opening portion for supplying power to the upper electrode 306, and a reference numeral 311 denotes a pad opening portion for supplying power to the lower electrode 301. Note that, in FIG. 26, the insulators 302 and 307 are not illustrated in order to show the lower electrode 301 and the upper electrode 306. Further, the cavity portion 303 and a side surface 312 of the opening portion of the upper electrode are illustrated in order to show the positional relation of the cavity portion 303 and the opening portion of the insulator 302. Further, a membrane of the CMUT cell in the fourth embodiment is constituted of the upper electrode 306 and the insulator 307.

In the CMUT cell according to the fourth embodiment, as shown in FIG. 26 and FIG. 27, the opening portion is formed in the insulator 302 between the upper electrode 306 and the lower electrode 301, and the upper electrode is formed so as to cover the opening portion. In this structure, since the space between electrodes in a part having the cavity portion 303 and the space between electrodes in a part not having the cavity portion 303 can be controlled independently, the thickness of the insulator sandwiched between the lower electrode 301 and the upper electrode 306 in a part not having the cavity portion 303 can be increased without increasing the space between the lower electrode 301 and the upper electrode 306 in a part having the cavity portion 303. Therefore, the decrease in the receiver sensitivity can be suppressed and the withstand voltage can be improved. More specifically, since the space between electrodes in a part having the cavity portion 303 remains unchanged, the amount of change in electric capacitance at the time of receiving ultrasonic waves is not changed, and also, since the thickness of the insulator sandwiched between electrodes in a part not having the cavity portion 303 can be increased, the electric parasitic capacitance can be suppressed.

Next, the manufacturing method of the CMUT cell using the MEMS technology according to the fourth embodiment of the present invention will be described with reference to FIG. 28 to FIG. 33. FIG. 28 to FIG. 33 are cross-sectional views schematically showing the CMUT cell in the manufacturing process, in which FIG. 28A to FIG. 33A show the cross sections taken along the line A-A' in FIG. 26 and FIG. 28B to FIG. 33B show the cross sections taken along the line B-B' in FIG. 26.

Figure 28A:
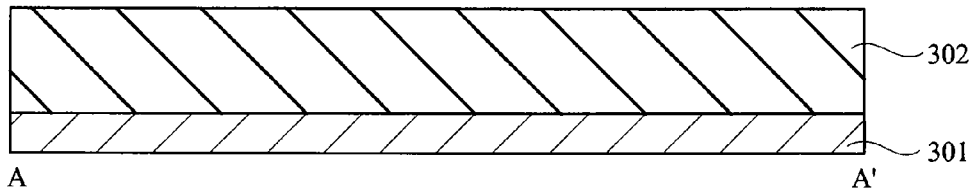
FIG. 28A is a cross-sectional view showing the CMUT cell in the manufacturing process taken along the line A-A' in FIG. 26 according to the fourth embodiment of the present invention.
Figure 28B:
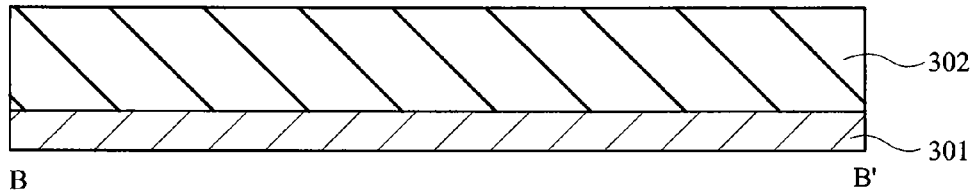
FIG. 28B is a cross-sectional view showing the CMUT cell in the manufacturing process taken along the line B-B' in FIG. 26 according to the fourth embodiment of the present invention.

First, as shown in FIG. 28A and FIG. 28B, the insulator 302 formed of a silicon oxide film is deposited to 400 nm on the lower electrode 301 formed of a conductive film by the plasma CVD (Chemical Vapor Deposition) method.

Figure 29A:
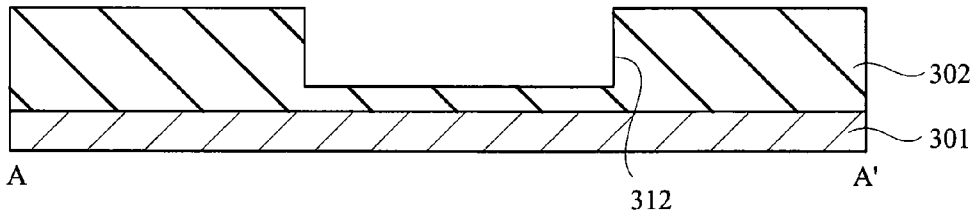
FIG. 29A is a cross-sectional view showing the CMUT cell in the manufacturing process continued from FIG. 28A taken along the line A-A' in FIG. 26.
Figure 29B:
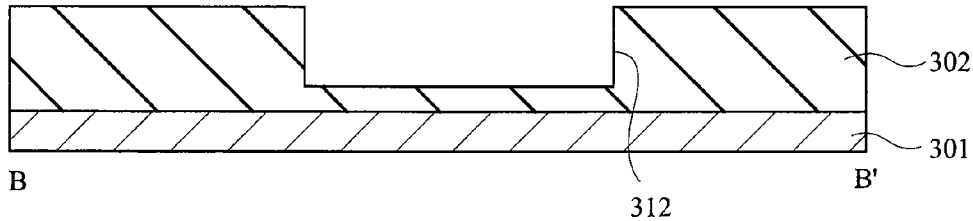
FIG. 29B is a cross-sectional view showing the CMUT cell in the manufacturing process continued from FIG. 28B taken along the line B-B' in FIG. 26.

Next, the insulator 302 is etched to 300 nm through photolithography process and dry etching process, thereby forming an opening portion that does not reach the lower electrode 301 in the insulator 302. The side surface of the opening portion is denoted by a reference numeral 312 (FIG. 29A and FIG. 29B).

Figure 30A:
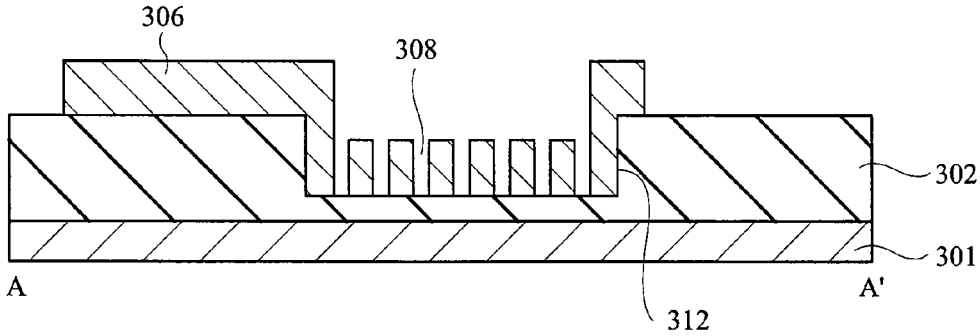
FIG. 30A is a cross-sectional view showing the CMUT cell in the manufacturing process continued from FIG. 29A taken along the line A-A' in FIG. 26.
Figure 30B:
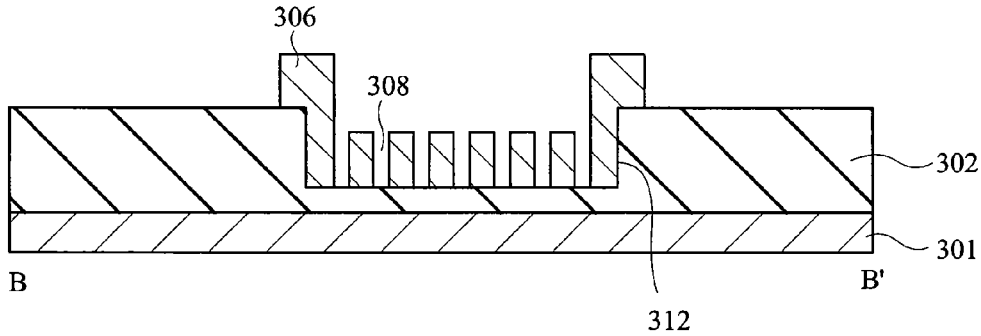
FIG. 30B is a cross-sectional view showing the CMUT cell in the manufacturing process continued from FIG. 29B taken along the line B-B' in FIG. 26.

Subsequently, tungsten (W) is deposited to 200 nm on the insulator 302 by the sputtering method, and the upper electrode 306 is formed through photolithography process and dry etching process. At this time, the wet etching holes 308 for forming the cavity portion 303 are simultaneously formed in the tungsten (W) deposited in the opening portion of the insulator 302 (FIG. 30A and FIG. 30B). The shape of the cavity portion can be determined by the arrangement of the wet etching holes 308 viewed from the top at this time.

Figure 31A:
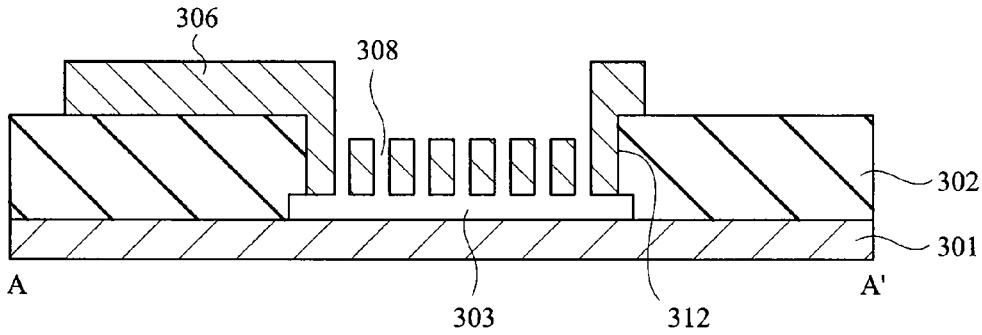
FIG. 31A is a cross-sectional view showing the CMUT cell in the manufacturing process continued from FIG. 30A taken along the line A-A' in FIG. 26.
Figure 31B:
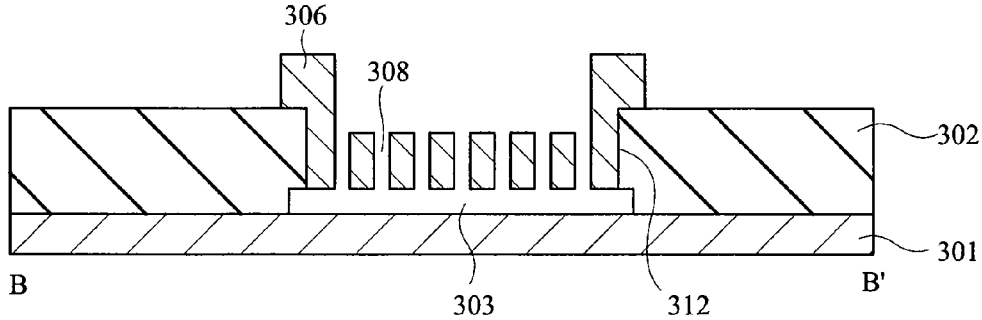
FIG. 31B is a cross-sectional view showing the CMUT cell in the manufacturing process continued from FIG. 30B taken along the line B-B' in FIG. 26.

Next, the insulator 302 is subjected to the wet etching using hydrofluoric acid through the wet etching holes 308, thereby forming the cavity portion 303 with the thickness of 100 nm (FIG. 31A and FIG. 31B).

Figure 32A:
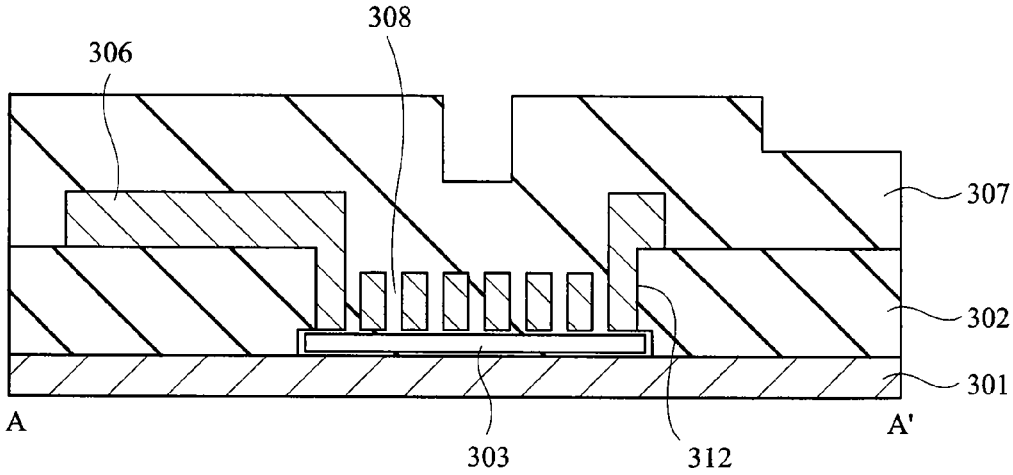
FIG. 32A is a cross-sectional view showing the CMUT cell in the manufacturing process continued from FIG. 31A taken along the line A-A' in FIG. 26.
Figure 32B:
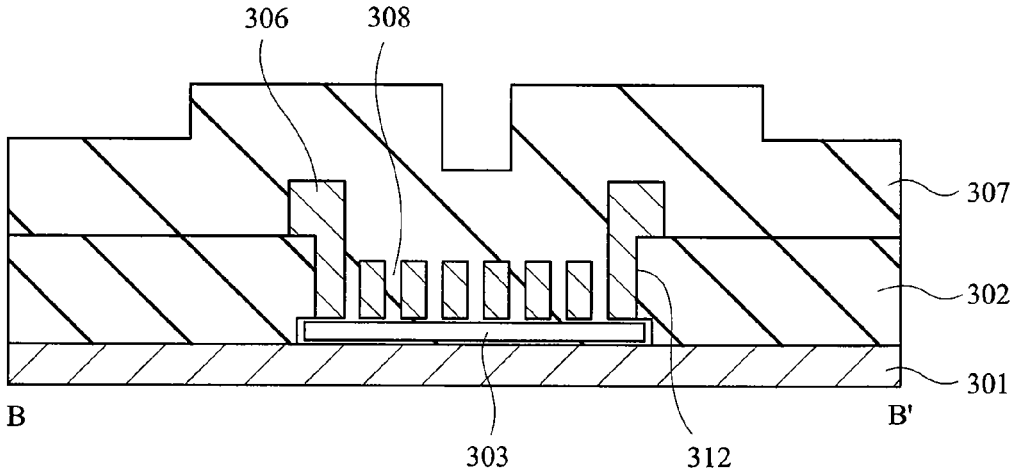
FIG. 32B is a cross-sectional view showing the CMUT cell in the manufacturing process continued from FIG. 31B taken along the line B-B' in FIG. 26.

Then, in order to bury the wet etching holes 308 formed in the upper electrode 306, the insulator 307 formed of a silicon oxide film is deposited to 500 nm by the plasma CVD method so as to cover the insulator 302 and the upper electrode 306. At this time, since the insulator 307 is deposited also on the inner wall of the cavity portion 303, even when the upper electrode 306 and the lower electrode 301 make contacts with each other, the insulation between the electrodes can be ensured. If the CVD method having good coating properties for step portions, for example, the atmospheric pressure CVD is used, the deposition of the insulator on the inner wall of the cavity portion 303 is accelerated, and the insulation between the electrodes can be further ensured (FIG. 32A and FIG. 32B).

Figure 33A:
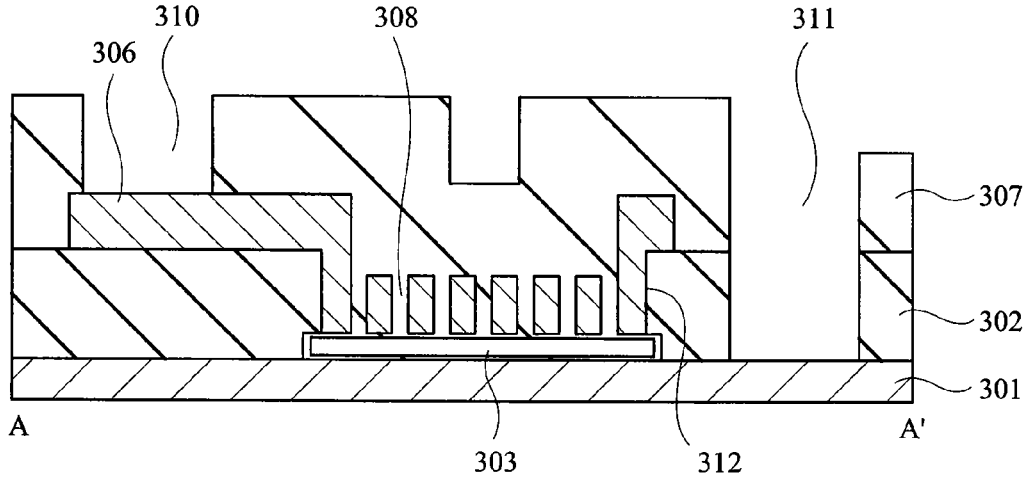
FIG. 33A is a cross-sectional view showing the CMUT cell in the manufacturing process continued from FIG. 32A taken along the line A-A' in FIG. 26.
Figure 33B:
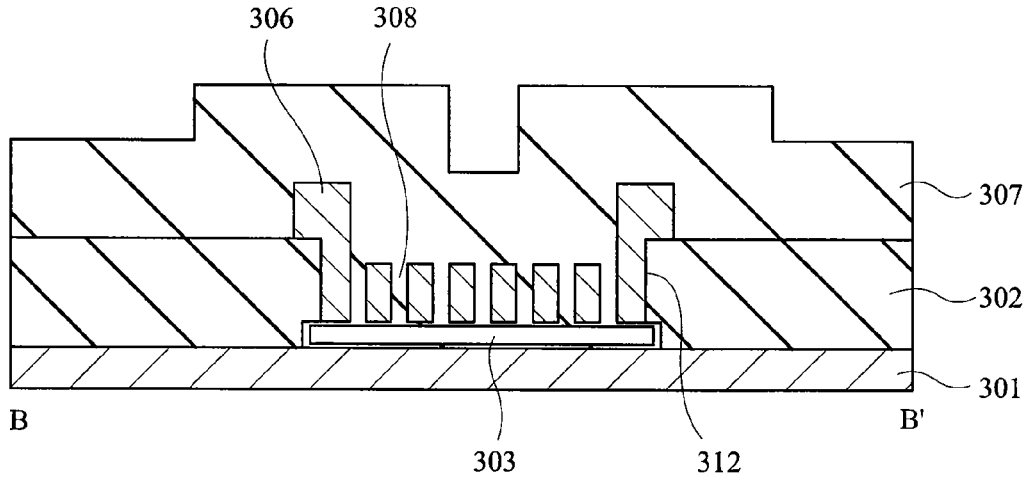
FIG. 33B is a cross-sectional view showing the CMUT cell in the manufacturing process continued from FIG. 32B taken along the line B-B' in FIG. 26.

Next, the opening portion 311 for electrically connecting the lower electrode 301 and the opening portion 310 for electrically connecting the upper electrode 306 are formed through photolithography process and dry etching process (FIG. 33A and FIG. 33B).

In this manner, the CMUT cell according to the fourth embodiment can be formed.

As described above, in the CMUT cell according to the fourth embodiment, the thickness of the insulator sandwiched between the lower electrode 301 and the upper electrode 306 in a part not having the cavity portion 303 can be increased in comparison to that in a part having the cavity portion 303. Therefore, since the space between the electrodes in a part having the cavity portion 303 remains unchanged, the amount of change in electric capacitance at the time of receiving ultrasonic waves is not changed, and also, since the thickness of the insulator sandwiched between the electrodes in a part not having the cavity portion 303 can be increased, the electric parasitic capacitance can be suppressed.

Although the CMUT cell shown in FIG. 26 is in the form of a single CMUT cell, even in the case where the CMUT cells are arranged in an array and the lower electrode thereof is divided, the thickness of the insulator sandwiched between the lower electrode 301 and the upper electrode 306 in a part not having the cavity portion 303 can be increased in comparison to that in a part having the cavity portion 303. Therefore, since the space between the electrodes in a part having the cavity portion 303 remains unchanged, the amount of change in electric capacitance at the time of receiving ultrasonic waves is not changed, and also, since the thickness of the insulator sandwiched between the electrodes in a part not having the cavity portion can be increased, the electric parasitic capacitance can be suppressed.

Note that, although the CMUT cell has an octagonal planar shape in FIG. 26, the shape of the CMUT cell is not restricted to this, and other shape such as circular shape and rectangular shape is also applicable.

Also, the materials for forming the CMUT cell described in the fourth embodiment are shown as a mere example of the combination thereof.

Further, any conductive film can be used for the lower electrode of the CMUT, and it is obvious that any of a semiconductor substrate, a conductive film on an insulator formed on a semiconductor substrate and a conductive film on a semiconductor substrate on which signal processing circuits are formed is also available.

Fifth Embodiment

Figure 34:
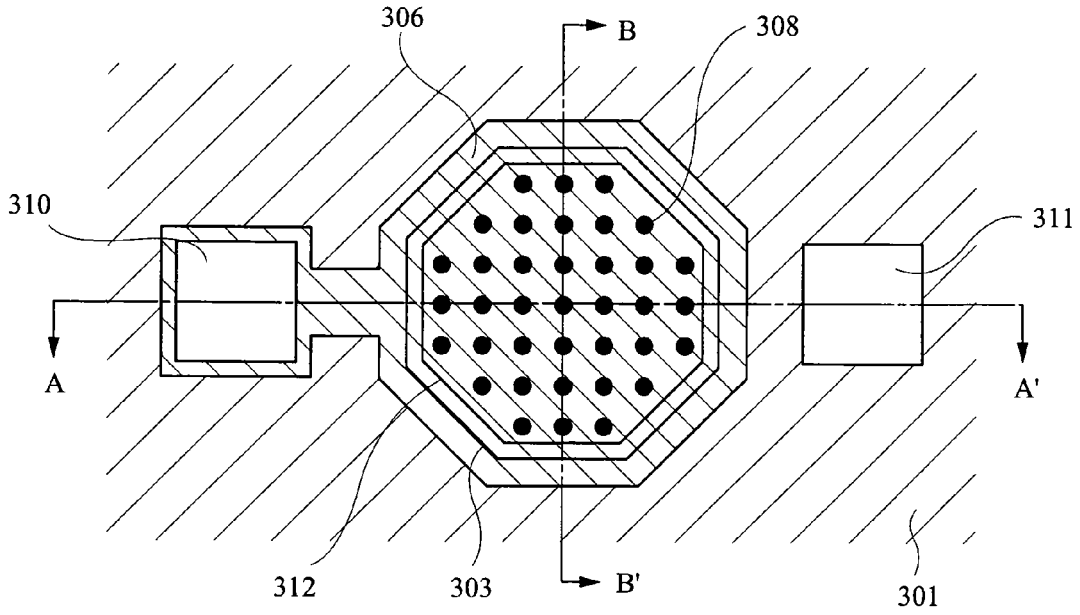
FIG. 34 is a plan view schematically showing the CMUT cell according to the fifth embodiment of the present invention.
Figure 35A:
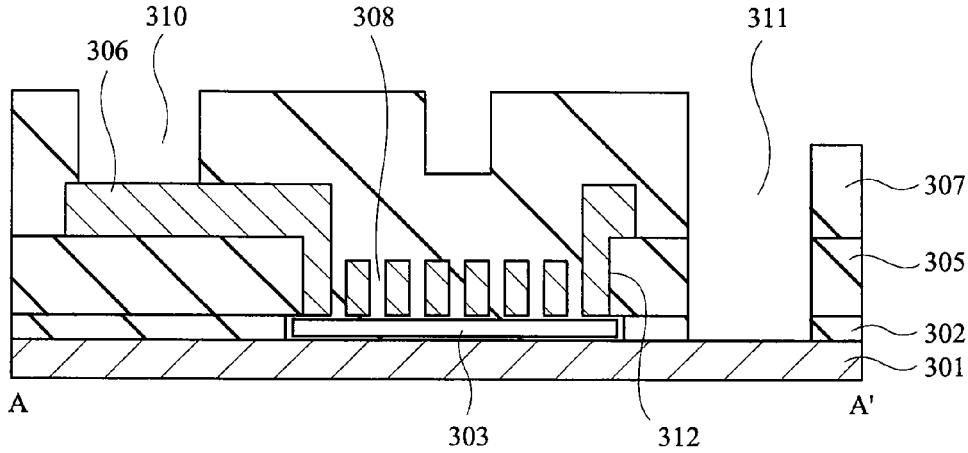
FIG. 35A is a cross-sectional view schematically showing the cross section of the CMUT cell taken along the line A-A' in FIG. 34 according to the fifth embodiment of the present invention.
Figure 35B:
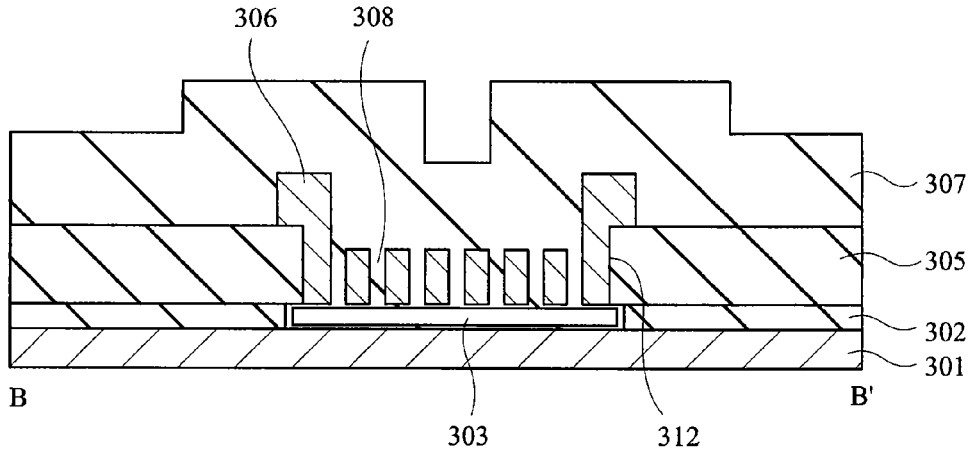
FIG. 35B is a cross-sectional view schematically showing the cross section of the CMUT cell taken along the line B-B' in FIG. 34 according to the fifth embodiment of the present invention.
Figure 36:
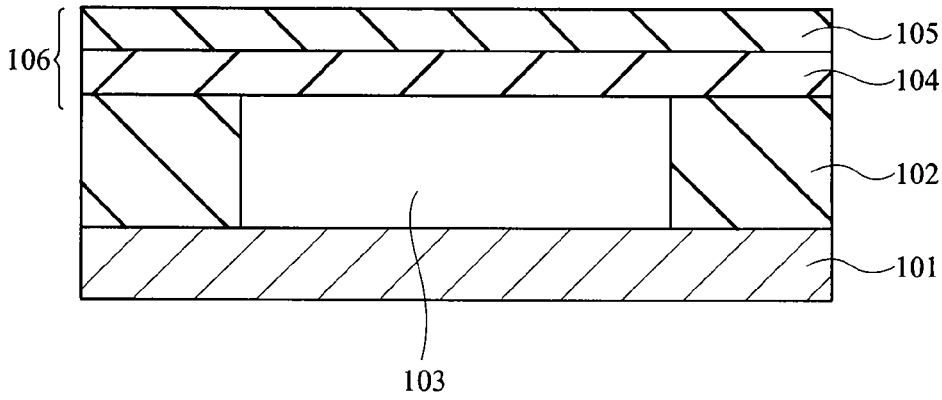
FIG. 36 is a cross-sectional view schematically showing an example of the CMUT cell examined by the inventors of the present invention.

First, a structure of a CMUT cell according to the fifth embodiment of the present invention will be described with reference to FIG. 34 and FIG. 35. FIG. 34 is a plan view schematically showing an upper surface of the CMUT cell, and FIG. 35A and FIG. 35B are cross-sectional views schematically showing the CMUT cell, in which FIG. 35A shows a cross section taken along the line A-A' in FIG. 34 and FIG. 35B shows a cross section taken along the line B-B' in FIG. 34.

In FIG. 34 and FIG. 35, a reference numeral 301 denotes a lower electrode, 302, 305 and 307 denote insulators, 303 denotes a cavity portion, 306 denotes an upper electrode, and 308 denotes a wet etching hole for forming the cavity portion 303. More specifically, the wet etching hole 308 is connected to the cavity portion 303. Further, a reference numeral 310 denotes a pad opening portion for supplying power to the upper electrode 306, and a reference numeral 311 denotes a pad opening portion for supplying power to the lower electrode 301. In FIG. 34, the insulators 302 and 307 are not illustrated in order to show the lower electrode 301 and the upper electrode 306. Further, the cavity portion 303 and a side surface 312 of the opening portion of the upper electrode are illustrated in order to show the positional relation of the cavity portion 303 and the opening portion of the insulator 302. Further, a membrane of the CMUT cell in the fifth embodiment is constituted of the upper electrode 306 and the insulator 307.

In the CMUT cell according to the fifth embodiment, as shown in FIG. 34 and FIG. 35, the insulator 302 and the insulator 305 are deposited between the upper electrode 306 and the lower electrode 301, the opening portion that reaches the insulator 302 is formed in the insulator 305, and the upper electrode is formed so as to cover the opening portion. In this structure, by forming the insulator 302 and the insulator 305 from different materials, the etching depth can be accurately controlled in the etching for forming the opening portion in the insulator 305. In other words, the thickness of the cavity portion 303 can be controlled. Further, similar to the fourth embodiment, since the space between electrodes in a part having the cavity portion and the space between electrodes in a part not having the cavity portion can be controlled independently, the thickness of the insulators sandwiched between the lower electrode 301 and the upper electrode 306 in a part not having the cavity portion 303 can be increased without increasing the space between the lower electrode 301 and the upper electrode 306 in a part having the cavity portion 303. Therefore, the decrease in the receiver sensitivity can be suppressed and the withstand voltage can be improved. More specifically, since the space between electrodes in a part having the cavity portion 303 remains unchanged, the amount of change in electric capacitance at the time of receiving ultrasonic waves is not changed, and also, since the thickness of the insulators sandwiched between electrodes in a part not having the cavity portion can be increased, the electric parasitic capacitance can be suppressed.

Next, the manufacturing method of the CMUT cell using the MEMS technology according to the fifth embodiment of the present invention will be described. The manufacturing method of the CMUT cell described in the fifth embodiment is approximately the same as the manufacturing method of the fourth embodiment shown in FIG. 28 to FIG. 33. The difference therebetween is that the insulator 302 of 400 nm is formed and then the insulator 302 of 300 nm is etched, thereby forming the opening portion in the insulator 302 as shown in FIG. 28 and FIG. 29 in the fourth embodiment, whereas, after the insulator 302 of 100 nm is formed, the insulator 305 of 300 nm is formed and then the insulator 305 is etched to reach the insulator 302, thereby forming the opening portion in the fifth embodiment.

As described above, in the CMUT cell according to the fifth embodiment, the thickness of the insulators sandwiched between the lower electrode 301 and the upper electrode 306 in a part not having the cavity portion 303 can be increased in comparison to that in a part having the cavity portion 303. Therefore, since the space between the electrodes in a part having the cavity portion 303 remains unchanged, the amount of change in electric capacitance at the time of receiving ultrasonic waves is not changed, and also, since the thickness of the insulators sandwiched between the electrodes in a part not having the cavity portion 303 can be increased, the electric parasitic capacitance can be suppressed.

Further, since two insulators such as the insulator 302 and the insulator 305 are sandwiched between the upper electrode 306 and the lower electrode 301, the thickness of the cavity portion 303 can be accurately controlled.

Although the CMUT cell shown in FIG. 34 and FIG. 35 is in the form of a single CMUT cell, even in the case where the CMUT cells are arranged in an array and the lower electrode thereof is divided, the thickness of the insulators sandwiched between the lower electrode 301 and the upper electrode 306 in a part not having the cavity portion 303 can be increased in comparison to that in a part having the cavity portion 303. Therefore, since the space between the electrodes in a part having the cavity portion 303 remains unchanged, the amount of change in electric capacitance at the time of receiving ultrasonic waves is not changed, and also, since the thickness of the insulators sandwiched between the electrodes in a part not having the cavity portion 303 can be increased, the electric parasitic capacitance can be suppressed.

Note that, although the CMUT cell has an octagonal planar shape in FIG. 34, the shape of the CMUT cell is not restricted to this, and other shape such as circular shape and rectangular shape is also applicable.

Also, the materials for forming the CMUT cell described in the fifth embodiment are shown as a mere example of the combination thereof.

Further, any conductive film can be used for the lower electrode of the CMUT, and it is obvious that any of a semiconductor substrate, a conductive film on an insulator formed on a semiconductor substrate and a conductive film on a semiconductor substrate on which signal processing circuits are formed is also available.

In the foregoing, the invention made by the inventors of the present invention has been concretely described based on the embodiments. However, it is needless to say that the present invention is not limited to the foregoing embodiments and various modifications and alterations can be made within the scope of the present invention.

The ultrasonic transducer of the present invention can be widely used for an institution which performs tests using ultrasonic waves such as medical tests and a manufacturing industry which manufactures inspection devices. Further, the manufacturing method thereof can be widely used for a manufacturing industry which manufactures the ultrasonic transducer.

What is claimed is:

1. An ultrasonic transducer, comprising:

a first lower wiring extending in a first direction;

a second lower wiring extending in the first direction;

an upper wiring disposed over the first and second lower wirings and extending in a second direction which crosses the first direction, and having a first region where the upper wiring extends toward the first lower wiring and a second region where the upper wiring extends toward the second lower wiring;

a first insulator disposed between the upper wiring in the first region and the first lower wiring;

a second insulator disposed between the upper wiring in the second region and the second lower wiring;

a first cavity portion disposed in the first insulator;

a second cavity portion disposed in the second insulator; and a third insulator disposed in a third region between the first cavity and the second cavity portion, wherein a sum total of a thickness of the third insulator between the first or second lower wiring and the upper wiring is larger than a sum total of a thickness of the first or second insulator.

2. The ultrasonic transducer according to claim 1, wherein the upper wiring is disposed on the third insulator and extends toward the third insulator in the third region.

3. The ultrasonic transducer according to claim 1, wherein the first cavity portion in disposed in the first insulator and the second cavity portion is disposed in the second insulator.

4. The ultrasonic transducer according to claim 1, wherein the first lower wiring is separated from the second lower wiring by the third insulator.

5. The ultrasonic transducer according to claim 1, wherein a first capacitive micromachined ultrasonic transducer (CMUT) cell comprises the first lower wiring, the first cavity portion, the first insulator, and the upper wiring, and wherein a second CMUT cell comprises the second lower wiring, the second cavity portion, the second insulator, and the upper wiring.

6. An ultrasonic transducer, comprising:

a first lower wiring extending in a first direction;

a second lower wiring extending in the first direction;

a first insulator disposed on the first and second lower wirings and disposed between the first and second lower wirings;

a first cavity portion disposed on the first insulator over the first lower wiring;

a second cavity portion disposed on the first insulator over the second lower wiring;

a second insulator disposed on the first insulator between the first and second cavity portions;

a third insulator disposed on the first and second cavity portions and the second insulator; and an upper wiring extending in a second direction which crosses the first direction, and being disposed on the third insulator.

7. The ultrasonic transducer according to claim 6, wherein a sum total of a thickness of the first, second, and third insulators within a region between the first and second cavity portions is larger than a sum total of a thickness of the first and third insulators within a region where the first or second cavity portions are disposed.

8. The ultrasonic transducer according to claim 6, wherein the upper wiring extends toward the third insulator between the first and second cavity portions.

9. The ultrasonic transducer according to claim 8, wherein the second insulator extends toward the first insulator between the first and second cavity portions, and the third insulator extends toward the second insulator between the first and second cavity portions.

10. The ultrasonic transducer according to claim 6, wherein the second insulator extends over a part of the first cavity portion and a part of the second cavity portion.

11. The ultrasonic transducer according to claim 6, wherein the upper wiring is constructed to have a first portion that is spaced inwardly toward the first lower wiring over the first cavity portion and a second cavity portion that is spaced inwardly toward the second lower wiring over the second cavity portion.

12. The ultrasonic transducer according to claim 6, wherein the first lower wiring is separated from the second lower wiring by the first insulator.

13. The ultrasonic transducer according to claim 6, wherein a first capacitive micromachined ultrasonic transducer (CMUT) cell comprises the first lower wiring, the first insulator, the first cavity portion, the second insulator, and the upper wiring, and wherein a second CMUT cell comprises the second lower wiring, the first insulator, the second cavity portion, the second insulator, and the upper wiring.

* * * * *